US006506969B1

(12) United States Patent
Baron

(10) Patent No.: US 6,506,969 B1
(45) Date of Patent: Jan. 14, 2003

(54) AUTOMATIC MUSIC GENERATING METHOD AND DEVICE

(75) Inventor: René Louis Baron, Saint Hilaire les Andrésis (FR)

(73) Assignee: Medal Sarl, Saint Hilaire les Andresis (FR)

( * ) Notice: Subject to any disclaimer, the term of this patent is extended or adjusted under 35 U.S.C. 154(b) by 0 days.

(21) Appl. No.: 09/787,979

(22) PCT Filed: Sep. 23, 1999

(86) PCT No.: PCT/FR99/02262

§ 371 (c)(1),
(2), (4) Date: Mar. 23, 2001

(87) PCT Pub. No.: WO00/17850

PCT Pub. Date: Mar. 30, 2000

(30) Foreign Application Priority Data

Sep. 24, 1998 (FR) ..... 98 12460
Jun. 23, 1999 (FR) ..... 99 08278

(51) Int. Cl.[7] ..... A63H 5/00; G04B 13/00; G10H 7/00

(52) U.S. Cl. ..... 84/609; 84/610; 84/613; 84/649; 84/650

(58) Field of Search ..... 84/600–602, 609–613, 84/615, 622–625, 634, 637, 649–653, 659–660, 666–669

(56) References Cited

U.S. PATENT DOCUMENTS 4,982,643 A * 1/1991 Minamitaka ..... 706/902
5,375,501 A 12/1994 Okuda ..... 84/611
5,525,749 A 6/1996 Aoki ..... 84/609
5,990,407 A * 11/1999 Gannon ..... 84/604
6,031,171 A * 2/2000 Tohgi et al. ..... 84/470 R
6,124,543 A * 9/2000 Aoki ..... 84/609
6,188,010 B1 * 2/2001 Iwamura ..... 84/477 R
6,326,538 B1 * 12/2001 Kay ..... 84/635

FOREIGN PATENT DOCUMENTS

EP 288 800 A2 A3 11/1988 ..... G10H/1/00

OTHER PUBLICATIONS

Yap Siong Chua, Composition Based on Pentatonic Scales: A Computer Aided Approach, IEEE,Los Alamitos, CA, USA, Jul. 1991, pp. 67–71.

* cited by examiner

*Primary Examiner*—Marlon T. Fletcher
(74) *Attorney, Agent, or Firm*—Joseph S. Tripoli; Paul P. Kiel

(57) ABSTRACT

The invention concerns a music generating method which consists in: an operation defining musical moments during which at least four notes are capable of being played, for example, bars or half-bars; an operation defining two families of note pitches, for each musical moment, the second family of note pitches having at least one note pitch which does not belong to the first family; an operation forming at least a succession of notes having at least two notes, each succession of notes being called a musical phrase, succession wherein, for each moment, each note whereof the pitch belongs exclusively to the second family is exclusively surrounded with notes of the first family; and an operation producing the output of a signal representing each pitch of each succession of notes.

41 Claims, 23 Drawing Sheets

AUTOMATIC MUSIC GENERATING METHOD AND DEVICE

This application claims the benefit under 35 U.S.C. §365 of International Application PCT/FR99/02262, filed Sep. 23, 1999, which was published in accordance with PCT Article 21(2) on Mar. 30, 2000 in French, and which claims the benefit of French Application No. 9812460, filed Sep. 24, 1998 and French Application No. 9908278, filed Jun. 23, 1999.

BACKGROUND OF THE INVENTION

The present invention relates to an automatic music generation procedure and system. It applies, in particular, to the broadcasting of background music, to teaching media, to telephone on-hold music, to electronic games, to toys, to music synthesizers, to computers, to camcorders, to alarm devices, to musical telecommunication and, more generally, to the illustration of sounds and to the creation of music.

The music generation procedures and systems currently known use a library of stored musical sequences which serve as a basis for manipulating automatic random assemblies. These systems have three main types of drawback:

- firstly, the musical variety resulting from the manipulation of existing musical sequences is necessarily very limited;
- secondly, the manipulation of parameters is limited to the interpretation of the assembly of sequences: tempo, volume, transposition, instrumentation; and
- finally, the memory space used by the "templates" (musical sequences) is generally very large (several megabytes).

These drawbacks limit the applications of the currently known music generation systems to the non-professional illustration of sounds and to didactic music.

SUMMARY OF THE INVENTION

The present invention intends to remedy these drawbacks. For this purpose, the subject of the present invention, according to a first aspect, is an automatic music generation procedure, characterized in that it comprises:

- an operation of defining musical moments during which at least four notes are capable of being played;
- an operation of defining two families of note pitches, for each musical moment, the second family of note pitches having at least one note pitch which is not in the first family;
- an operation of forming at least one succession of notes having at least two notes, each succession of notes being called a musical phrase, in which succession, based on a phrase of at least three notes, each note whose pitch belongs exclusively to the second family is surrounded exclusively by notes of the first family; and
- an operation of outputting a signal representative of each note pitch of each said succession.

By virtue of these arrangements, the succession of note pitches has both a very rich variety, since the number of successions that can be generated in this way is several thousands, and harmonic coherence, since the polyphony generated is governed by constraints.

According to particular characteristics during the operation of defining two families of note pitches, for each musical moment, the first family is defined as a set of note pitches belonging to the current harmonic chord duplicated from octave to octave.

According to further particular characteristics, during the operation of defining two families of note pitches, the second family includes at least the pitches, of a scale whose mode has been defined, which are not in the first family.

By virtue of these arrangements, the definition of the families is easy and the alternation of notes of the two families is harmonious.

According to further particular characteristics, during the operation of forming at least one succession of notes having at least two notes, each musical phrase is defined as a set of notes the starting times of which are not mutually separated, in pairs, by more than a predetermined duration.

By virtue of these arrangements, a musical phrase consists, for example, of notes the starting times of which are not separated by more than three semiquavers (or sixteenth notes).

According to further particular characteristics, the music generation procedure furthermore includes an operation of inputting values representative of physical quantities and in that at least one of the operations of defining musical moments, by definition of two families of note pitches, formed from at least one succession of notes, is based on the value of at least one value of a physical quantity.

By virtue of these arrangements, the musical piece may be put into relationship with a physical event, such as an image, a movement, a shape, a sound, a keyed input, phases of a game whose physical quantity is representative, etc.

According to a second aspect, the subject of the invention is an automatic music generation system, characterized in that it comprises:

- a means of defining musical moments during which at least four notes are capable of being played;
- a means of defining two families of note pitches, for each musical moment, the second family of note pitches having at least one note pitch which is not in the first family;
- a means of forming at least one succession of notes having at least two notes, each succession of notes being called a musical phrase, in which succession, for each moment, each note whose pitch belongs exclusively to the second family is surrounded exclusively by notes of the first family; and
- a means of outputting a signal representative of each note pitch of each said succession.

The subject of the present invention, according to a third aspect, is a music generation procedure, characterized in that it comprises:

- an operation of processing information representative of a physical quantity during which at least one value of a parameter called a "control parameter" is generated;
- an operation of associating each control parameter with at least one parameter called a "music generation parameter" each corresponding to at least one note to be played during a musical piece; and
- a music generation operation using each music generation parameter to generate a musical piece.

By virtue of these arrangements, not only may a note depend on a physical quantity, as in a musical instrument, but a music generation parameter relating to at least one note to be played depends on a physical quantity.

According to particular characteristics, the music generation operation comprises, successively:

- an operation of automatically determining a musical structure composed of moments comprising bars (or mesures), each bar having times and each time having note start locations;

an operation of automatically determining densities, probabilities of the start of a note to be played, these being associated with each location; and an operation of automatically determining rhythmic cadences according to densities.

According to particular characteristics, the music generation operation comprises:

an operation of automatically determining harmonic chords which are associated with each location;

an operation of automatically determining families of note pitches according to the rhythmic chord which is associated with a location; and an operation of automatically selecting a note pitch associated with each location corresponding to the start of a note to be played, according to said families and to rules of predetermined composition.

According to further particular characteristics, the music generation operation comprises:

an operation of automatically selecting orchestral instruments;

an operation of automatically determining a tempo;

an operation of automatically determining the overall tonality of the piece;

an operation of automatically determining an intensity for each location corresponding to the start of a note to be played;

an operation of automatically determining the duration of each note to be played;

an operation of automatically determining rhythmic cadences of arpeggios; and/or an operation of automatically determining rhythmic cadences of accompaniment chords.

According to particular characteristics, during the music generation operation each density depends on said tempo (speed of performing the piece).

According to a fourth aspect, the subject of the invention is a music generation procedure which takes into account a family of descriptors, each descriptor relating to several possible start locations of notes to be played in a musical piece, said procedure comprising, for each descriptor, an operation of selecting a value, characterized in that, for at least some of said descriptors, said value depends on at least one physical quantity.

According to a fifth aspect, the subject of the present invention is a music generation system, characterized in that it comprises:

a means of processing information representative of a physical quantity designed to generate at least one value of a parameter called a "control parameter";

a means of associating each control parameter with at least one parameter called a "music generation parameter" each corresponding to at least one note to be played during a musical piece;

a music generation means using each music generation parameter to generate a musical piece.

According to a sixth aspect, the subject of the invention is a music generation system which takes into account a family of descriptors, each descriptor relating to several possible start locations of notes to be played in a musical piece, characterized in that it comprises a means for selecting, for each descriptor, a value dependent on at least one physical quantity.

By virtue of each of these arrangements, the music generated is consistent and pleasant to listen to, since the musical parameters are linked together by constraints. In addition, the music generated is neither "gratuitous", nor accidental, nor entirely random. It corresponds to external physical quantities and may even be made without any human assistance, by the acquisition of values of physical quantities.

The subject of the present invention, according to a seventh aspect, is a music generation procedure, characterized in that it comprises:

a music generation initiation operation;

an operation of selecting control parameters;

an operation of associating each control parameter with at least one parameter called a "music generation parameter" corresponding to at least two notes to be played during a musical piece; and a music generation operation using each music generation parameter to generate a musical piece.

According to particular characteristics, the initiation operation comprises an operation of connection to a network, for example the Internet network.

According to further particular characteristics, the initiation operation comprises an operation of reading a sensor.

According to further particular characteristics, the initiation operation comprises an operation of selecting a type of music.

According to further particular characteristics, the initiation operation comprises an operation of selecting musical parameters by a user.

According to further particular characteristics, the music generation operation comprises, successively:

an operation of automatically determining a musical structure composed of moments comprising bars, each bar having beats and each beat having note start locations;

an operation of automatically determining densities, probabilities of the start of a note to be played, these being associated with each location;

an operation of automatically determining rhythmic cadences according to densities.

According to further particular characteristics, the music generation operation comprises:

an operation of automatically determining harmonic chords which are associated with each location;

an operation of automatically determining families of note pitches according to the chord associated with a location, with the position of this location within the beat of one bar, with the occupancy of the adjacent positions and with the presence of the possible adjacent notes;

an operation of automatically selecting a note pitch associated with each location corresponding to the start of a note to be played, according to said families and to predetermined composition rules.

According to further particular characteristics, the music generation operation comprises:

an operation of automatically selecting orchestral instruments;

an operation of automatically determining a tempo;

an operation of automatically determining the overall tonality of the piece;

an operation of automatically determining an intensity for each location corresponding to the start of a note to be played;

an operation of automatically determining the duration of each note to be played;

an operation of automatically determining rhythmic cadences of arpeggios; and/or an operation of automatically determining rhythmic cadences of accompaniment chords.

According to further particular characteristics, during the music generation operation each density depends on said tempo (speed of performing the piece).

According to an eighth aspect, the subject of the present invention is a music generation system characterized in that it comprises:

a music generation initiation means;

a means of selecting control parameters;

a means of associating each control parameter with at least one parameter called a "music generation parameter" corresponding to at least two notes to be played during a musical piece;

a music generation means using each music generation parameter to generate a musical piece.

According to a ninth aspect, the subject of the present invention is a musical coding procedure, characterized in that the coded parameters are representative of a density, of a rhythmic cadence and/or of families of notes.

By virtue of each of these arrangements, the generated music is consistent and pleasant to listen to, since the musical parameters are linked together by control parameters. In addition, the music generated is neither "gratuitous" nor accidental, nor entirely random. It corresponds to control parameters and may even be made without any human assistance, by means of sensors.

These second to ninth aspects of the invention have the same particular characteristics and the advantages as the first aspect. These are therefore not repeated here.

The subject of the invention is also a compact disc, an information medium, a modem, a computer and its peripherals, an alarm, a toy, an electronic game, an electronic gadget, a postcard, a music box, a camcorder, an image/sound recorder, a musical electronic card, a music transmitter, a music generator, a teaching book, a work of art, a radio transmitter, a television transmitter, a television receiver, an audio cassette player, an audio cassette player/recorder, a video cassette player, a video cassette player/recorder, a telephone, a telephone answering machine and a telephone switchboard, characterized in that they comprise a system as succinctly explained above.

The subject of the invention is also a digital sound card, an electronic music generation card, an electronic cartridge (for example for video games), an electronic chip, an image/sound editing table, a computer, a terminal, computer peripherals, a video camera, an image recorder, a sound recorder, a microphone, a compact disc, a magnetic tape, an analog or digital information medium, a music transmitter, a music generator, a teaching book, a teaching digital data medium, a work of art, a modem, a radio transmitter, a television transmitter, a television receiver, an audio or video cassette player, an audio or video cassette player/recorder and a telephone.

The subject of the invention is also:

a means of storing information that can be read by a computer or a microprocessor storing instructions for a computer program, characterized in that it makes it possible for the procedure of the invention, as succinctly explained above, to be implemented locally or remotely;

a means of storing information which is partially or completely removable and is readable by a computer or a microprocessor storing instructions for a computer program, characterized in that it makes it possible for the procedure of the invention, as succinctly explained above, to be implemented locally or remotely; and a means of storing information obtained by implementation of the procedure according to the present invention or use of a system according to the present invention.

The preferred or particular characteristics, and the advantages of this compact disc, of this information medium, of this modem, of this computer, of these peripherals, of this alarm, of this toy, of this electronic game, of this electronic gadget, of this postcard, of this music box, of this camcorder, of this image/sound recorder, of this musical electronic card, of this music transmitter, of this music generator, of this teaching book, of this work of art, of this radio transmitter, of this television transmitter, of this television receiver, of this audio cassette player, of this audio cassette player/recorder, of this video cassette player, of this video cassette player/recorder, of this telephone, of this telephone answering machine, of this telephone switchboard and of these information storage means being identical to those of the procedure as succinctly explained above, these advantages are not repeated here.

BRIEF DESCRIPTION OF THE DRAWINGS

Further advantages and characteristics of the invention will become apparent from the description which follows, given with regard to the appended drawings in which.

Figure 1:
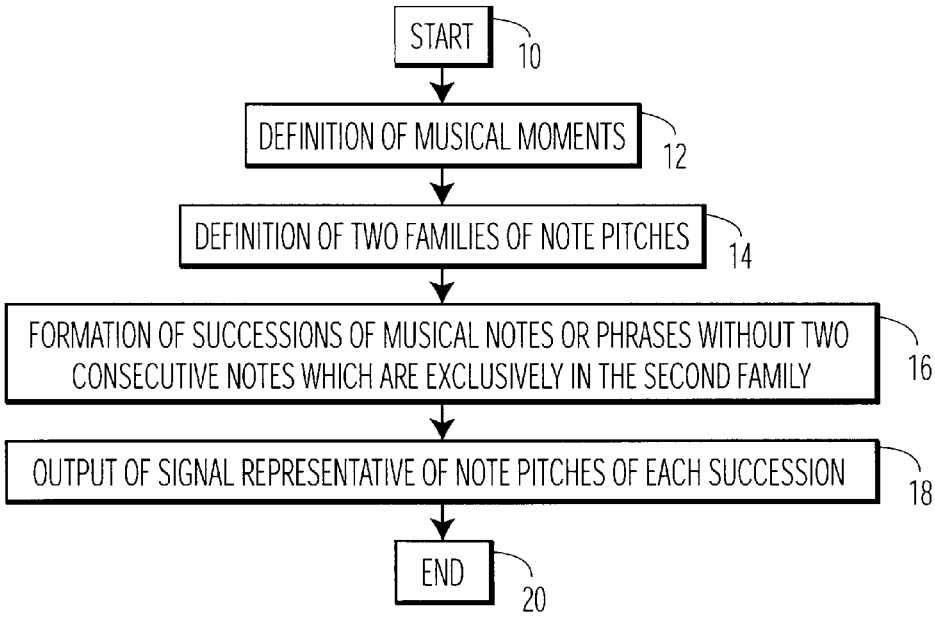
FIG. 1 shows, schematically, a flow chart for automatic music generation in accordance with one method of implementing the procedure according to the present invention.

After the start 10, during an operation 12, musical moments are defined during an operation 12. For example, during the operation 12, a musical piece comprising bars are defined, each bar including times and each time including note locations. In this example, the operation 12 consists in assigning a number of bars to the musical piece, a number of times to each bar and a number of note locations to each time or a minimum note duration.

During operation 12, each musical moment is defined in such a way that at least four notes are capable of being played over its duration.

Next, during an operation 14, two families of note pitches are defined for each musical moment, the second family of note pitches having at least one note pitch which is not in the first family. For example, a scale and a chord are assigned to each half-bar of the musical piece, the first family comprising the note pitches of this chord, duplicated from octave to octave, and the second family comprising at least the note pitches of the scale which are not in the first family. It may be seen that various musical moments or consecutive musical moments may have the same families of note pitches.

Next, during an operation 16, at least one succession of notes having at least two notes is formed with, for each moment, each note whose pitch belongs exclusively to the second family being surrounded exclusively by notes of the first family. For example, a succession of notes is defined as a set of notes the starting times of which are not mutually separated, in pairs, by more than a predetermined duration. Thus, in the example explained with operation 14, for each half-bar, a succession of notes does not have two consecutive note pitches which are exclusively in the second family of note pitches.

During an operation 18, a signal representative of the note pitches of each succession is emitted. For example, this signal is transmitted to a sound synthesizer or to an information medium. The music generation then stops at the operation 20.

Figure 2:
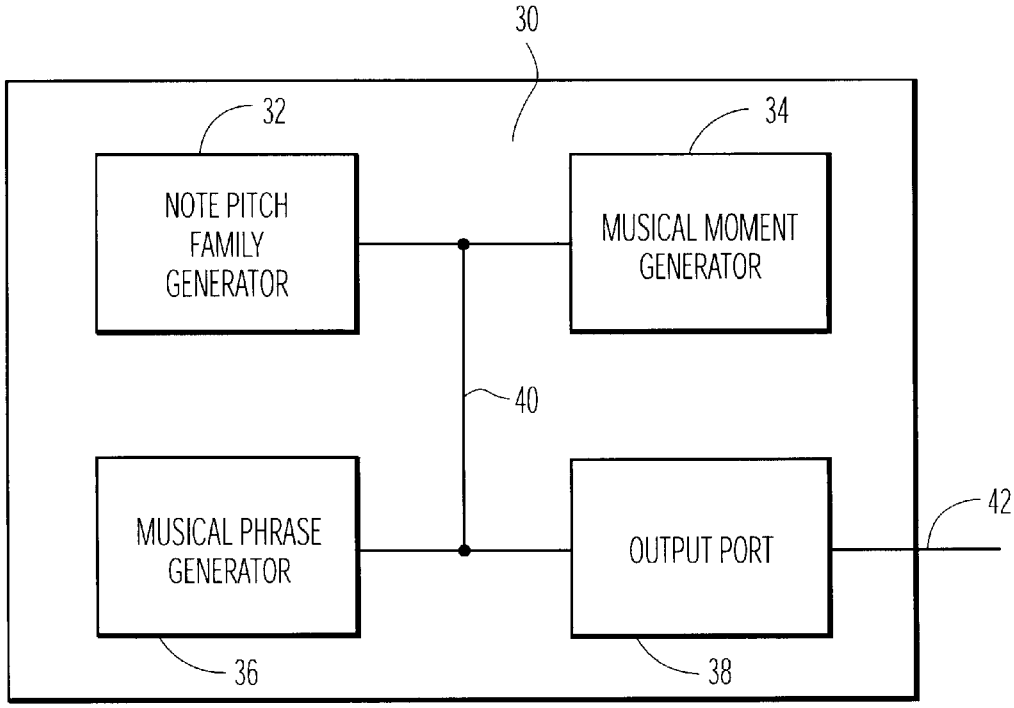
FIG. 2 shows, in the form of a block diagram, one embodiment of a music generation system according to the present invention.

FIG. 2 shows, in the form of a block diagram, one embodiment of the music generation system according to the present invention. In this embodiment, the system 30 comprises, linked together by at least one signal line 40, a note pitch family generator 32, a musical moment generator 34, a musical phrase generator 36 and an output port 38. The output port 38 is linked to an external signal line 42.

The signal line 40 is a line capable of carrying messages or information. For example, it is an electrical or optical conductor of known type. The musical moment generator 34 defines musical moments in such a way that four notes are capable of being played during each musical moment. For example, the musical moment generator defines a musical piece by a number of bars that it contains and, for each bar, a number of beats, and for each beat, a number of possible note start locations or minimum note duration.

The note pitch family generator 32 defines two families of note pitches for each musical moment. The generator 32 defines the two families of note pitches in such a way that the second family of note pitches has at least one note pitch which is not in the first family of note pitches. For example, a scale and a chord are assigned to each half-bar of the musical piece, the first family comprising the note pitches of this chord, duplicated from octave to octave, and the second family comprising at least the note pitches of the scale which are not in the first family. It may be seen that various musical moments or consecutive musical moments may have the same families of note pitches.

The musical phrase generator 36 generates at least one succession of notes having at least two notes, each succession being formed in such a way that, for each moment, each note whose pitch belongs exclusively to the second family is surrounded exclusively by notes of the first family. For example, a succession of notes is defined as a set of notes the starting times of which are not mutually separated, in pairs, by more than a predetermined duration. Thus, in the example explained with the note pitch family generator 32, for each half-bar, a succession of notes does not have two consecutive note pitches which are exclusively in the second family of note pitches.

The output port 38 transmits, via the external signal line 42, a signal representative of the note pitches of each succession is emitted. For example, this signal is transmitted, via the external line 42, to a sound synthesizer or to an information medium.

The music generation system 30 comprises, for example, a general-purpose computer programmed to implement the present invention, a MIDI sound card linked to a bus of the computer, a MIDI synthesizer linked to the output of the MIDI sound card, a stereo amplifier linked to the audio outputs of the MIDI synthesizer and speakers linked to the outputs of the stereo amplifier.

Figure 3:
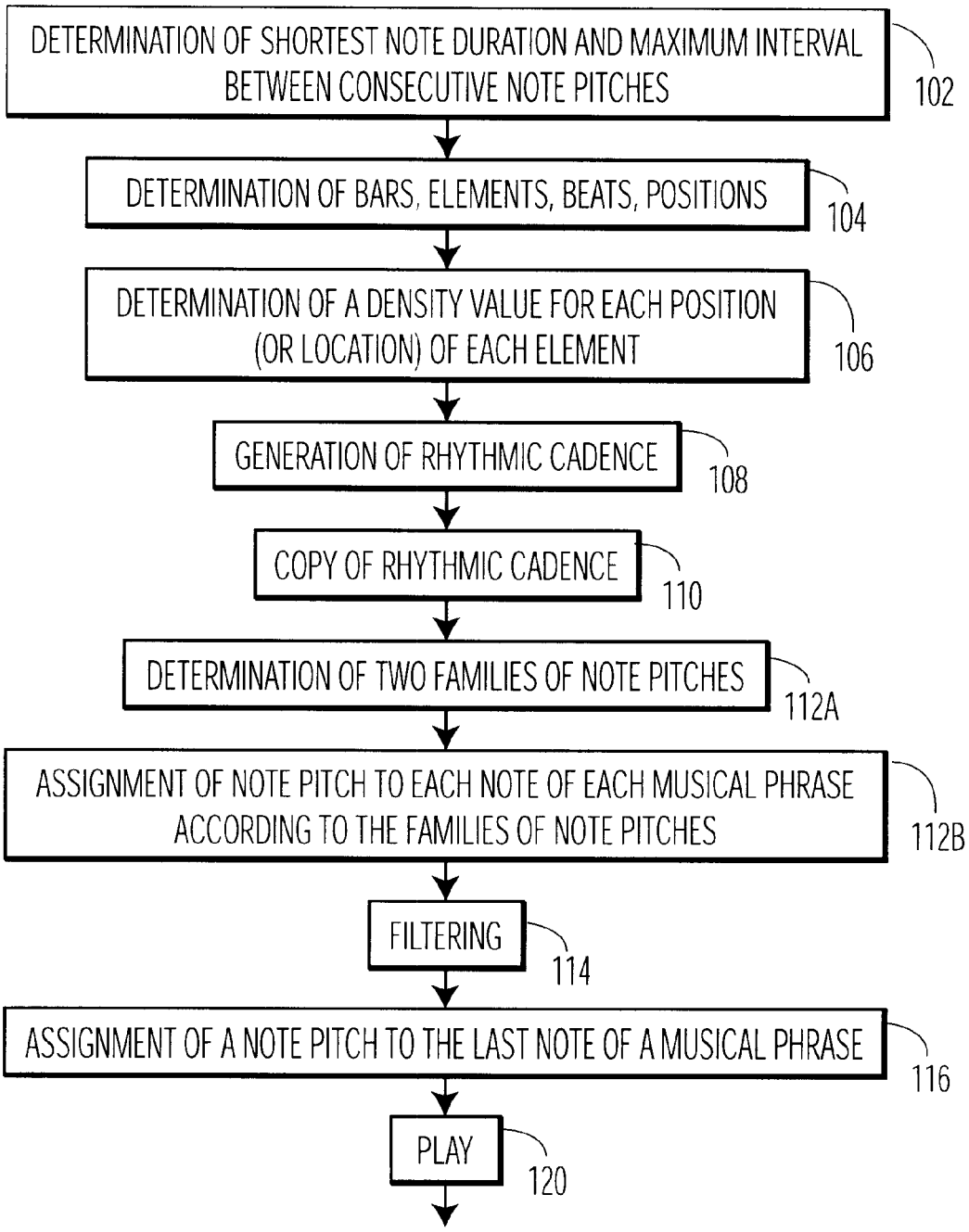
FIG. 3 shows, schematically, a flow chart for music generation according to a first embodiment of the present invention.
Figure 4A:
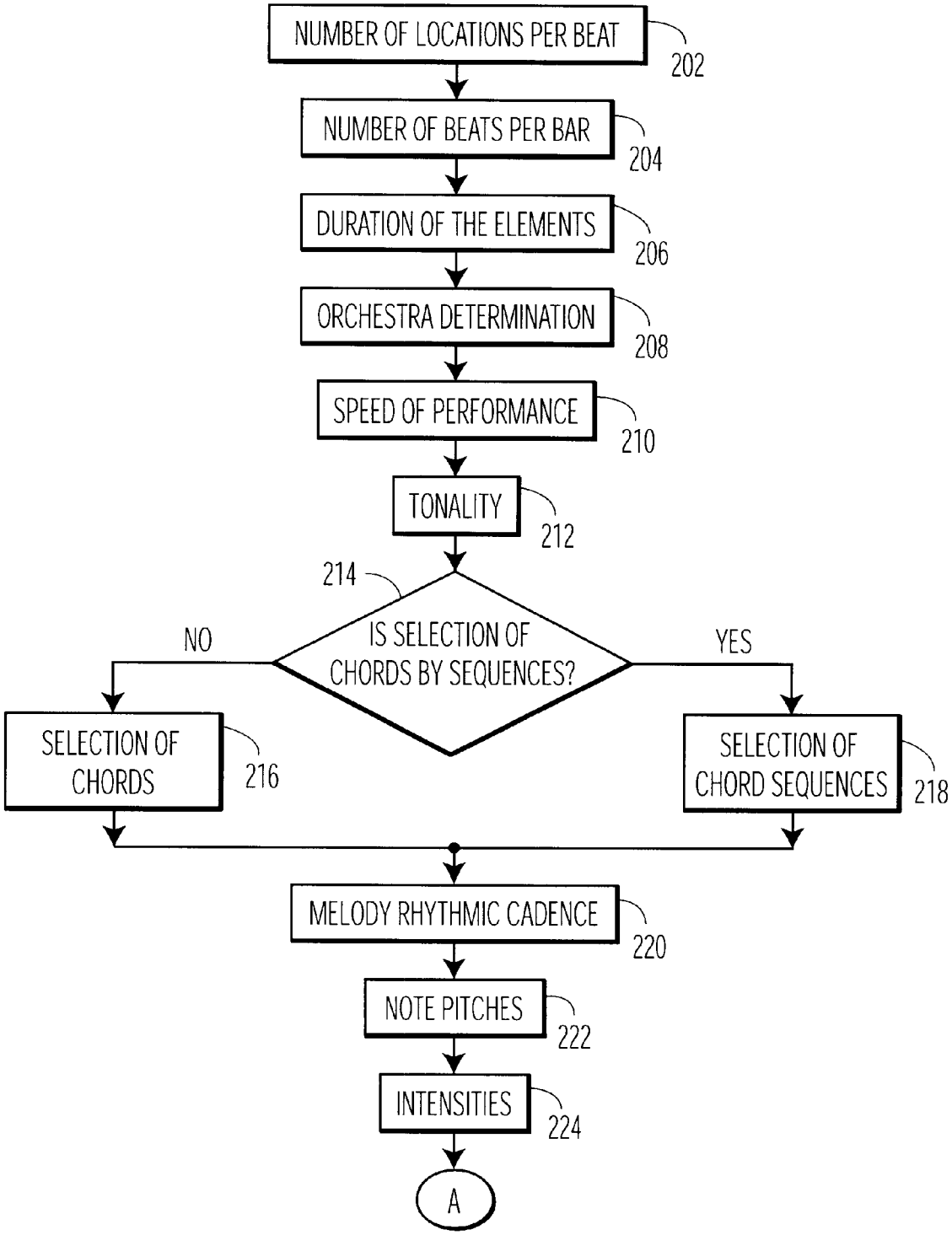
FIGS. 4A and 4B show, schematically, a flow chart for music generation according to a second embodiment of the present invention.
Figure 4B:
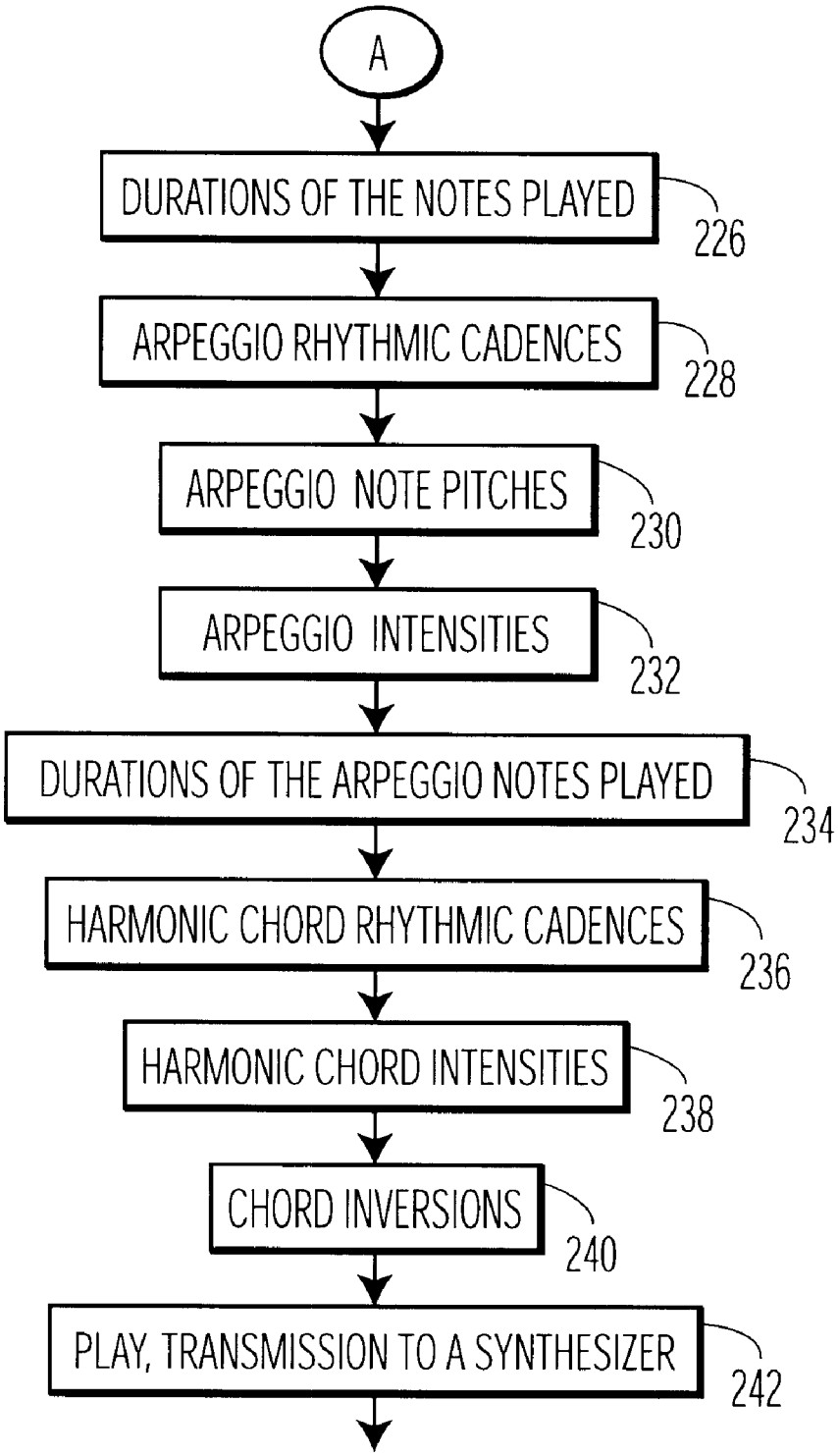

In the description of the second and third method of implementation, and in particular in the description of FIGS. 3, 4A and 4B, the expression "randomly or nonrandomly" is used to express the fact that, independently of one another, each parameter to which this expression refers may be selected randomly or be determined by a value of a physical quantity (for example one detected by a sensor) or a choice made by a user (for example by using the keys of a keyboard), depending on the various methods of implementing the present invention.

As illustrated in FIG. 3, in a second simplified method of implementation for the purpose of only generating and playing the melodic line (or song), the procedure according to the present invention carries out:

- an operation 102 of determining, randomly or nonrandomly, the shortest duration that a note can have in the musical piece and the maximum interval, expressed as the number of semitones between two consecutive note pitches (see operation 114);
- an operation 104 of determining, randomly or nonrandomly, on a time scale, the number of occurrences of each element (introduction, semi-couplets, couplets, refrains, semi-refrains, finale) of a musical piece and the identities between these elements, a number of bars which make up each element, a number of beats which make up each bar and a number of time units, called hereafter "positions" or "locations", each time location having a duration equal to the shortest note to be generated, for each beat;
- an operation 106 of defining, randomly or nonrandomly, a density value for each location of each element of the piece, the density of a location being representative of the probability that, at this time location, a note of the melody is positioned thereat (that it to say, for the playing phase, that the note starts to be played);
- an operation 108 of generating a rhythmic cadence which determines, randomly or nonrandomly, for each position or location, depending on the density associated with this position or with this location during operation 106, whether a note of the melody is positioned thereat, or not;

an operation 110 of copying rhythmic sequences corresponding to similar repeated elements (refrains, couplets, semi-refrains, semi-couplets) of the musical piece or to identical elements (introduction, finale), (thus, at the end of operation 110, the positions of the notes are determined but not their pitch, that is to say their fundamental frequency);

an operation 112 of assigning note pitches to the notes belonging to the rhythmic cadence, during which:

during an operation 112A, for each half-bar, two families of note pitches (for example, the first family composed of note pitches corresponding to a chord of a scale, possibly duplicated from octave to octave, and the second family composed of note pitches of the same scale which are not in the first family) are determined randomly or nonrandomly and during an operation 112B, for each set of notes (called hereafter a musical phrase or succession), the starting times of which are not mutually separated, in pairs, by more than a predetermined duration (corresponding, for example, to three positions), note pitches of the first family of notes are randomly assigned to the even-rank locations in said succession and note pitches of the second family of notes are randomly assigned to the odd-rank locations in said succession (it may be seen that if the families change during the succession, for example at the half-bar change, the rule continues to be observed throughout the succession);

a filtering operation 114, possibly integrated into the note-pitch assignment operation 112, during which if two consecutive note pitches in the succession are spaced apart by more than the interval determined during operation 102, expressed as the number of semitones, the pitch of the second note is randomly redefined and operation 114 is repeated;

an operation 116 of assigning a note pitch to the last note of the succession, the note pitch being taken from the first family of note pitches; and a play operation 120 carried out by controlling a synthesizer module in such a way that it plays the melodic line defined during the above operations and a possible orchestration.

During operation 120, the durations for playing the notes of the melody are selected randomly without, however, making the playing of two consecutive notes overlap—the intensities of the note pitches are selected randomly. The durations and intensities are repeated for each element copied during operation 110 and an automatic orchestration is generated in a known manner. Finally, the instruments of the melody and of the orchestra are determined randomly or nonrandomly.

In the method of implementation illustrated in FIG. 3, there is only one type of intensity: the notes placed off the beat are played with greater stress than the notes placed on the beat. However, a random selection seems more human. For example, if the aim is to have a mean intensity of 64 for a note positioned at the first location of a beat, an intensity of between 60 and 68 per beat is randomly selected. If the aim is to have a mean intensity of 76 for a note positioned at the third location of a beat, an intensity of between 72 and 80 is randomly selected for this note. For the notes positioned at the second and fourth locations of the beat, an intensity value which depends on the intensity of the previous or following note and lower than this reference intensity is chosen. As an exception, a note at the start of a musical phrase, if its pitch is in the first family of note pitch, a high intensity, for example 85, is chosen. Also as an exception, the last note in a musical phrase is associated with a low intensity, for example 64.

The following intensities are chosen, for example, for the various accompaniment instruments:

for the bass notes: the notes placed on the beat are stressed more than those placed off the beat, the rare intermediate notes being stressed even more;

arpeggios: the same as for the base notes, except that the intermediate notes are less stressed;

rhythmic chords: the notes placed on the beat are stressed less than those placed off the beat, the intermediate notes being even less stressed; and thirds: lower intensities than those of the melody, but proportional to the intensities of the melody, note by note. If the couplet is played twice, the intensities are repeated for the same notes and the same instruments. The same applies to the refrain.

With regard to the durations of the notes played, they are selected randomly with weightings which depend on the number of locations in the beats. When the duration available before the next note is one unit of time, the duration of the note is one unit of time. When the available duration is two units of time, a random selection is made between the following durations: a complete quaver (5 chances in 6) or a semiquaver followed by a semiquaver rest (1 chance in 6). When the available duration is three units of time, a random selection is made between the following durations: a complete dotted quaver (4 chances in 6), a quaver followed by a semiquaver rest (2 chances in 6). When the available duration is 4 units of time, a random selection is made between the following durations: a complete crotchet (7 chances in 10), a dotted quaver followed by a semiquaver rest (2 chances in 10) or a quaver followed by a quaver rest (1 chance in 10). When the available duration is greater than 4 units of time, a random selection is made so as to choose the complete available duration (2 chances in 10), half the available duration (2 chances in 10), a crotchet (2 chances in 10), if the available duration so allows, a minim (2 chances in 10) or a semibreve or whole note (2 chances in 10). If there is a change in family during a musical phrase, the playing of the note is stopped except if the note belongs to the equivalent families before and after the change in family.

It may be seen that, as a variant, during operation 112A, the second family of note pitches possibly includes at least one note pitch of the first family and during operations 112B and 114 the note pitches of each succession are defined in such a way that two consecutive notes of the same half-bar and of the same succession cannot belong exclusively to the second family of note pitches.

As illustrated in FIGS. 4A and 4B, in a third method of embodiment, the procedure and the system of the present invention carry out operations of determining:

A/the structure within the beat, comprising:

an operation 202 of defining, randomly or nonrandomly, a maximum number of locations or positions (each corresponding to the minimum duration of a note in the piece) to be played per beat, here, for example, 4 locations called successively e1, e2, e3 and e4;

B/the structure within the bar, comprising:

an operation 204 of defining, randomly or nonrandomly, the number of beats per bar, here, for example, 4 beats per bar, which therefore corresponds to 16 positions or locations;

C/the overall structure of the piece, comprising:

an operation 206 of defining, randomly or nonrandomly, the durations of the elements of the musical piece (refrain, semi-refrain, couplet, semi-couplet, introduction, finale), in terms of numbers of bars, and the number of repeats of the elements in the piece; here, the introduction has a duration of 2 bars, the couplet a duration of 8 bars, the refrain a duration of 8 bars, each refrain and each couplet being played twice, and the finale being the repetition of the refrain;

D/the instrumentation, comprising:

an operation 208 of determining, randomly or nonrandomly, an orchestra composed of instruments accompanied by setting values (overall volume, reverberation, echoes, panning, envelope, clarity of sound, etc.);

E/the tempo, comprising:

an operation 210 of generating, randomly or nonrandomly, a speed of execution of the playing;

F/the tonality, comprising:

an operation 212 of generating, randomly or nonrandomly, a positive or negative transposition value, the base tonality, the transposition value of which is "zero" being, arbitrarily, C major; the transposition is a value which shifts the melody and its accompaniment by one or more tones, upward or downward, with respect to the first tonality (stored in the random memory). The percussion part is not affected by the transposition. This "transposition" value is repeated during the interpretation step and is added to each note pitch just before they are sent to the synthesizer (except on the percussion "track") and this value may be, as here, constant throughout the duration of the piece, or may vary for a change of tone, for example during a repeat;

G/the harmonic chords, comprising:

an operation 214 of selecting, randomly or nonrandomly, a chord selection mode from two possible modes:

if the first chord selection mode is selected, an operation 216 of selecting, randomly or nonrandomly, harmonic chords, if the second chord selection mode is selected, an operation 218 of selecting, randomly or nonrandomly, harmonic chord sequences, on the one hand, for the refrain and, on the other hand, for the couplet.

Thus, the chord sequence is formed:

either by a random or nonrandom selection, chord by chord (each chord selected being chosen or rejected depending on the constraints according to the rules of the musical art); however, in other methods of implementation, this chord sequence may either be input by the user/composer or generated by the harmonic consequence of a dense first melodic line (for example, two, three, four notes per beat) having an algorithmic character (for example, a fugue) or not, and the notes of which are output (by random or nonrandom selection) from scales and from harmonic modes chosen randomly or nonrandomly;

or by random or nonrandom selection of a group of eight chords stored in memory from a hundred or so other groups. Since each chord relates here to a bar, a group of eight chords relates to eight bars.

In the method of implementation described and shown, the invention is applied to the generation of songs and the harmonic chords used are chosen from perfect minor and major chords, diminished chords, and dominant seventh, eleventh, ninth and major seventh chords.

H/the melody, comprising:

H1/the rhythmic cadence of the melody, including an operation 220 of assigning, randomly or nonrandomly, densities to each location of an element of the musical piece, in this case to each location of a refrain beat and to each location of a couplet beat, and then of generating, randomly or nonrandomly, three rhythmic sequences of two bars each, the couplet receiving the first two rhythmic cadences repeated 2 times and the refrain receiving the third rhythmic cadence repeated 4 times. In the example described and shown in FIG. 4, the locations e1 and e3 have, averaged over all the density selections, a mean density (for example of the order of magnitude of ?) greater than the locations e2 and e4 (for example of the order of magnitude of ⅕). However, each density is weighted by a multiplicative coefficient inversely proportional to the speed of execution of the piece (the higher the speed, the lower the density);

H2/the note pitches, including an operation 222 of selecting note pitches defined by the rhythmic cadence. During this operation 222, two families of note pitches are formed. The first family of note pitches consists of the note pitches of the harmonic chord associated with the position of the note and the second composed of the note pitches of the scale of the overall basic harmony (the current tonality) reduced (or, as a variant, not reduced) by the note pitches of the first family of note pitches. During this operation 222, at least one of the following constraint rules is applied to the choice of note pitches:

there is never a succession of two notes which are exclusively in the second family, the pitches of the notes selected for the locations el (positions 1, 5, 9, 13, 17, etc.) always belong to the first family (apart from exceptional cases, that is to say in less than one quarter of the cases), two starts of notes placed in two successive positions belong alternately to one of the two families of note pitches and then to the other ("alternation rule"), when there is no start of a note to be played at the locations e2 and e4, the note pitch of the possible note which starts at e3 is in the second family of note pitches, the last note of a succession of note starts, followed by at least three positions without a note start, has a note pitch in the first family (via a local violation of the alternation rule), the note pitch at e4 belongs to the first note family when there is a change of harmonic chord at the next position (e1) (via a local violation at e4 of the alternation rule) and the pitch interval between note starts in two successive positions is limited to 5 semitones;

H3/the intensity of the notes of the melody, including an operation 224 of generating, randomly or nonrandomly, the intensity (volume) of the notes of the melody according to their location in time and to their position in the piece;

H4/the durations of the notes, including an operation 226 of generating, randomly or nonrandomly, the end time of each note played;

I/the musical arrangement, comprising:

an operation 228 of generating, randomly or nonrandomly, two rhythmic cadences of the notes of arpeggios, having the lengths of a bar each, the first being coupled so as to be associated with the entire couplet and the second being copied so as to be associated with the entire refrain, an operation 230 of generating, randomly or nonrandomly, note pitches of arpeggios from the note pitches of the first family of note pitches, with an interval between two successive note pitches of less than or equal to 5 semitones;

an operation 232 of generating, randomly or nonrandomly, the intensities (volume) of the notes of arpeggios. Thus, each of the two "arpeggio" rhythmic cadences of a bar receives intensity values at the locations of the notes "to be played". Each of the two arpeggio intensity values is distributed (copied) over the part of the piece in question: one over the couplet and the other over the refrain;

an operation 234 of generating, randomly or nonrandomly, durations of arpeggio notes;

an operation 236 of generating, randomly or nonrandomly, two rhythmic cadences for the playing of harmonic chords, copied so as to be spread, one over the couplet and the other over the refrain, arrangement chords which are played when the arpeggios are not played (the rhythmic cadence of the accompaniment chords, for example played by the guitar, receives random or nonrandom values according to the same method as the rhythmic cadences of arpeggio notes. These values initiate or do not initiate the playing of the accompaniment guitar. If, at the same moment, an arpeggio note has to be played, the chord has priority and the arpeggio note is canceled);

an operation 238 of generating, randomly or nonrandomly, the intensities of rhythmic chords;

an operation 240 of generating, randomly or nonrandomly, chord inversions; and J/the playing of the piece, comprising an operation 242 of transmitting to a synthesizer all the setting values and the values for playing the various instruments defined during the previous operations.

In the second method of implementation described and shown, a musical piece is composed and interpreted using the MIDI standard. MIDI is the abbreviation for "Musical Instrument Digital Interface" (and which means the digital communication interface between musical instruments). This standard employs:

a physical connection between the instruments, which takes the form of a two-way serial interface via which the information is transmitted at a given rate; and a standard for information exchange ("general MIDI") via the cables linked to the physical connections, the meaning of predetermined digital sequences corresponding to predefined actions of the musical instruments (for example, in order to play the note "middle C" of the keyboard in the first channel of a polyphonic synthesizer, the sequence 144, 60, 80). The MIDI language relates to all the parameters for playing a note, for stopping a note, for the pitch of a note, for the choice of instrument and for setting the "effects" of the sound of the instrument:

reverberation, chorus effect, echoes, panning, vibrato, glissando.

These parameters suffice for producing music with several instruments: MIDI uses 16 parallel polyphonic channels. For example, with the G800 system of the ROLAND brand, 64 notes played simultaneously can be obtained.

However, the MIDI standard is only an intermediate between the melody generator and the instrument.

If a specific electronic circuit (for example of the ASIC—Application Specific Integrated Circuit—type) were to be used, it would no longer be essential to comply with the MIDI standard.

In parallel with the playing phase is an actual interpretation phase, the interpretation being by means of random or nonrandom variations, in real time, carried out note by note, on the expression, vibrato, panning, glissasndo and intonation, for all of the notes of each instrument.

It may be seen here that all the random selections are based on integer numbers, possibly negative numbers, and that a selection from an interval bounded by two values may give one of these two values. Preferably, the scale of pitch notes of the melody is limited to the tessitura of the human voice. The note pitches are therefore distributed over a scale of about one and a half octaves, i.e. in MIDI language, from note 57 to note 77. As regards note pitches of the bass line (for example the contrabass), in the method of implementation described, the playing of the bass plays once per beat and on the beat (location "e1"). Moreover, a playing correlation is established with the melody: when the intensity of a note of the melody exceeds a certain threshold, this results in the generation of a possibly additional note of the bass which may not be located on the beat, but at the half-beat (location "e3") or at intermediate locations (locations "e1" and "e4"). The pitch of this possibly additional bass note has the same pitch as that of the melody but two octaves lower (in MIDI language, note 60 thus becomes 36).

Figure 5:
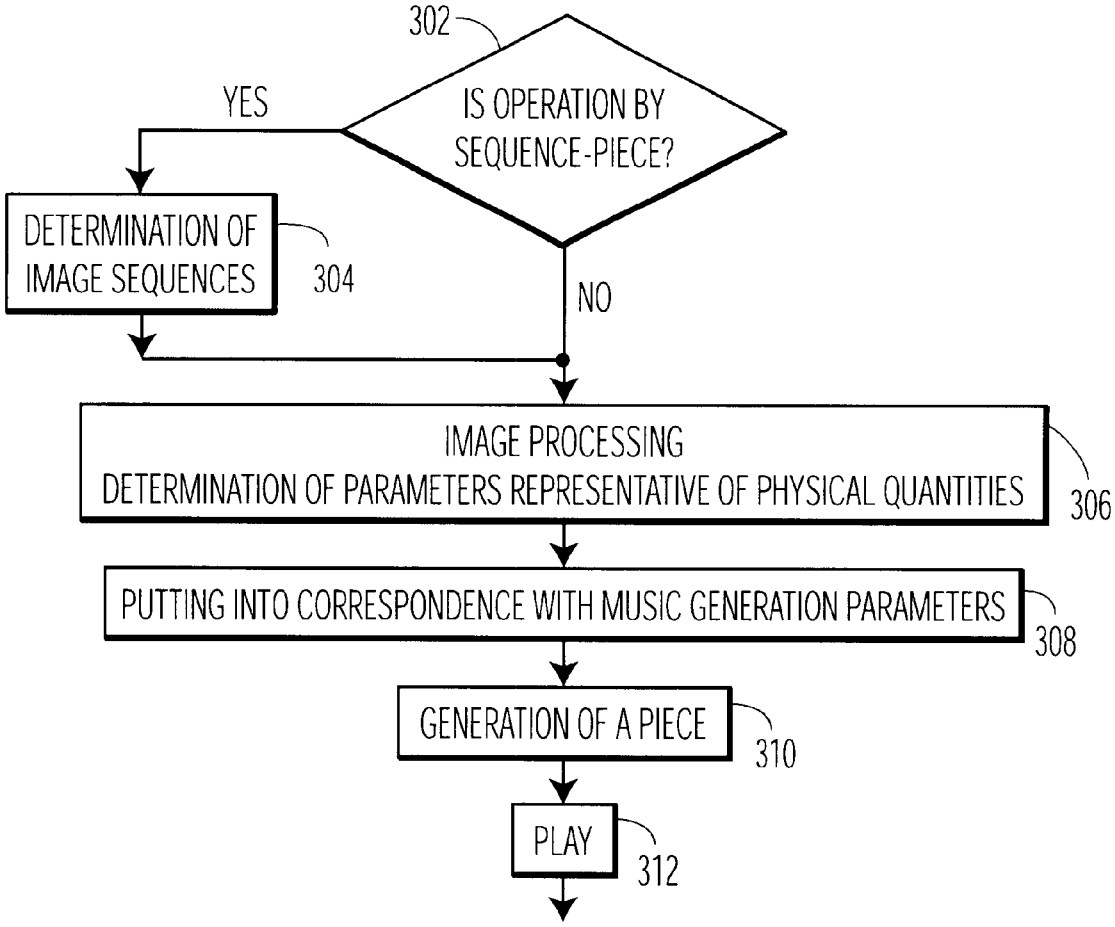
FIG. 5 shows a flow chart for determining music generation parameters according to a third method of implementing the present invention.

FIG. 5 shows a fifth and a sixth method of implementing the present invention, in which at least one physical quantity (in this case, an item of information representative of an image) influences at least one of the musical parameters used for the automatic music generation according to the present invention.

As illustrated in FIG. 5, in a fifth method of implementation combined with the third method of implementation (FIG. 3), at least one of the following music generation parameters:

the shortest duration that a note may have in the musical work, the number of time units per beat, the number of beats per bar, a density value associated with each location, the first family of note pitches, the first family of note pitches, the predetermined interval or number of semitones which constitutes the maximum interval between two consecutive note pitches, is representative of a physical quantity, here an optical physical quantity represented by an image information source.

As illustrated in FIG. 5, in a sixth method of implementation combined with the fourth method of implementation (FIGS. 4A and 4B), at least one of the following music generation parameters:

number of locations or positions per beat, number of beats per bar, duration of a refrain, duration of a couplet, duration of the introduction, duration of the finale, number of repeats of the elements of the piece, the choice of orchestra, the settings of the instruments of the orchestra (overall volume, reverberation, echoes, panning, envelope, clarity of sound, etc.), the tempo, the tonality, the selection of the harmonic chords, a density associated with a location, for each location, each family of note pitches, each rule applicable or not applicable to the note pitches, the maximum pitch interval between two successive note pitches, the intensity associated with each location, the duration of the notes, the densities associated with the locations for the arpeggios, the intensity associated with each location for the arpeggios, the duration of the arpeggio notes, the densities associated with the locations for the harmonic chords and the intensity associated with each location for the rhythmic chords, is representative of a physical quantity, here an optical physical quantity represented by an image information source. Thus, in FIG. 5, during an operation 302, an operating mode is selected between a sequence-and-song operating mode and a "with the current" operating mode, by progressive modification of music generation parameters. When the first operating mode is selected, during an operation 304, the user selects a duration of the musical piece in selects, with a keyboard (FIG. 6), the start and end of a sequence of moving images. Then, during an operation 306, a sequence of images or the last ten seconds of images coming from a video camera or from an image storage device (for example, a video tape recorder, a camcorder or a digital information medium reader) is processed using image processing techniques known to those skilled in the art, in order to determine at least one of the following parameters:

the mean luminance of the image;

the change in mean luminance of the image;

frequency of large luminance variation;

amplitude of luminance variation;

mean chrominance of the image;

change in the mean chrominance of the image;

frequency of large chrominance variation;

amplitude of chrominance variation;

duration of the shots (detected by a sudden change between two successive images of mean luminance and/or of mean chrominance);

movements in the image (camera or object).

Next, during an operation 308, each parameter value determined during the operation 306 is put into correspondence with at least one value of a music generation parameter described above.

Next, during an operation 310, a piece (first operating mode) or two elements (refrain and couplet, second operating mode) of a piece are generated in accordance with the associated method of music generation implementation (third and fourth methods of implementation, illustrated in FIGS. 3 and 4).

Finally, during an operation 312, the music piece generated is played synchronously with display of the moving image, stored in an information medium.

In the second operating mode (gradually changing "with the current" music generation), the music generation parameters changes gradually from one musical moment to the next.

Figure 6:
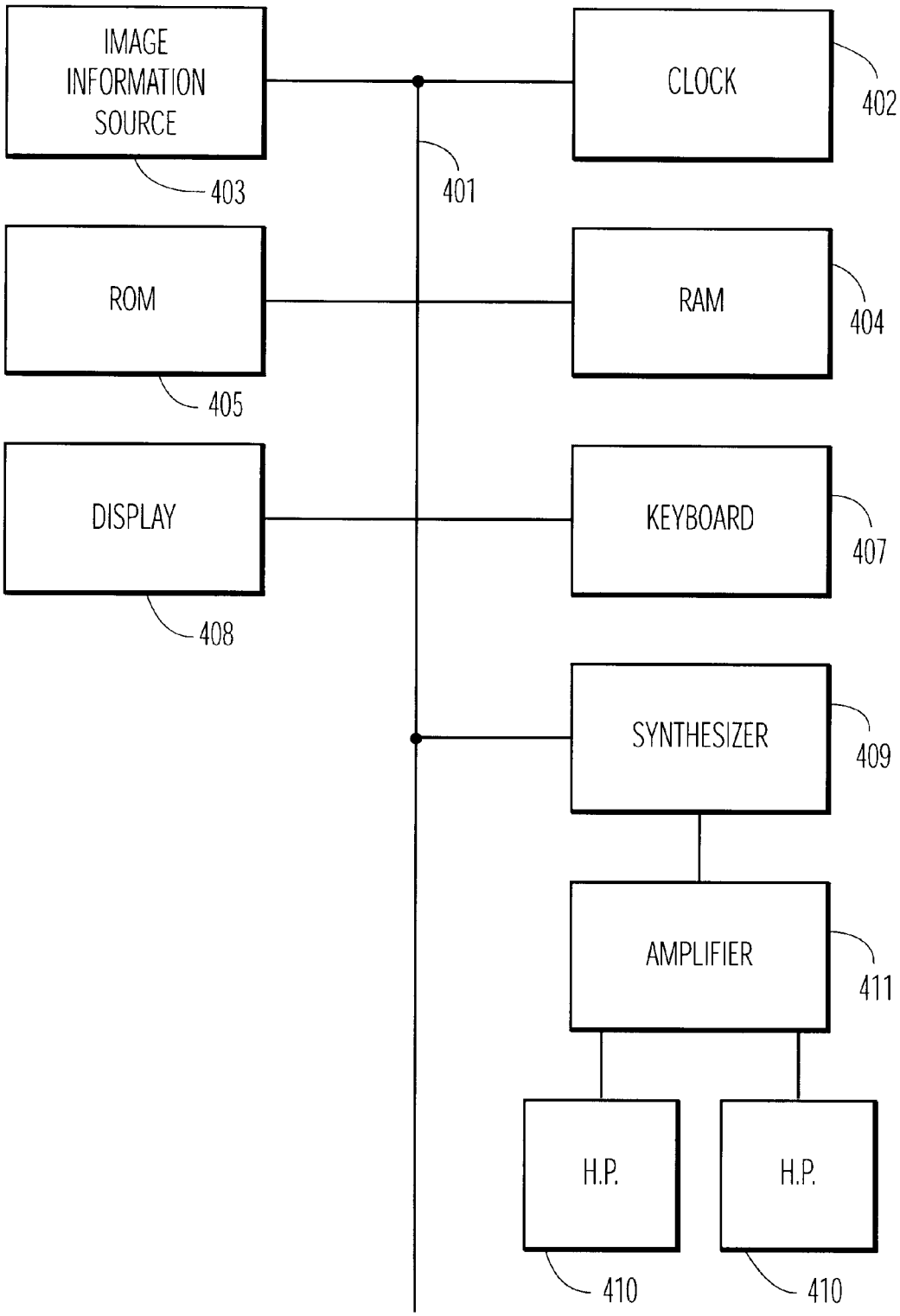
FIG. 6 shows a system suitable for implementing the flow chart illustrated in FIG. 5.

FIG. 6 shows, for carrying out the various methods of implementing the music generation procedure of the present invention which are illustrated in FIGS. 3 to 5, linked together by a data and address bus 401:

a clock 402, which determines the rate of operation of the system;

an image information source 403 (for example, a camcorder, a video tape recorder or a digital moving-image reader);

a random-access memory 404 in which intermediate processing data, variables and processing results are stored;

a read-only memory 405 in which the program for operating the system is stored;

a processor (not shown) which is suitable for making the system operate and for organizing the datastreams on the bus 401, in order to execute the program stored in the memory 405;

a keyboard 407 which allows the user to choose a system operating mode and, optionally, to designate the start and end of a sequence (first operating mode);

a display 408 which allows the user to communicate with the system and to see the moving image displayed;

a polyphonic music synthesizer 409; and a two-channel amplifier 411, linked to the output of the polyphonic music synthesizer 409, and two loudspeakers 410 linked to the output of the amplifier 411.

The polyphonic music synthesizer 409 uses the functions and systems adapted to the MIDI standard allowing it to communicate with other machines provided with this same implantation and thus to understand the General MIDI codes which denote the main parameters of the constituent elements of a musical work, these parameters being delivered by the processor 406 via a MIDI interface (not shown).

As an example, the polyphonic music synthesizer 409 is of the ROLAND brand with the commercial reference E70. It operates with three incorporated amplifiers each having a maximum output power of 75 watts for the high-pitched and medium-pitched sounds and of 15 watts for the low-pitched sound.

Figure 7:
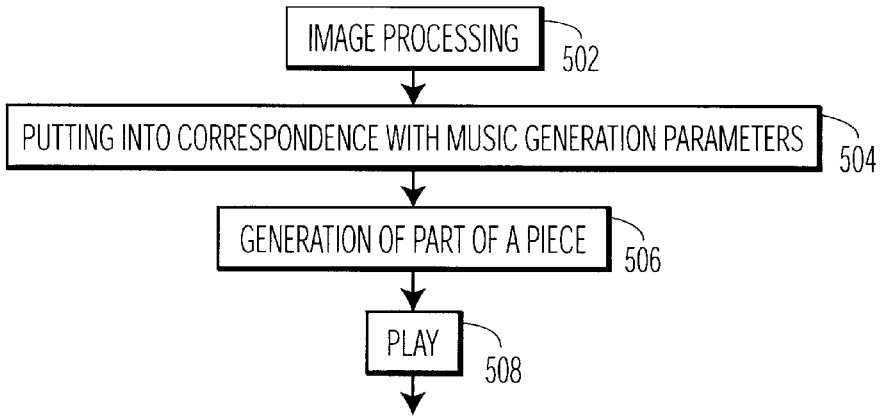
FIG. 7 shows a flow chart for determining music generation parameters according to a fourth method of implementing the present invention.

As illustrated in FIG. 7, in a seventh method of implementation combined with the method of implementation illustrated in FIG. 3, at least one of the following music generation parameters:

the shortest duration that a note may have in the musical work, the number of time units per beat, the number of beats per bar, a density value associated with each location, the first family of note pitches, the first family of note pitches, the predetermined interval or number of semitones which constitutes the maximum interval between two consecutive note pitches, is representative of a physical quantity coming from a sensor, in this case an image sensor.

As illustrated in FIG. 7, in an eighth method of implementation combined with the method of implementation illustrated in FIGS. 4A and 4B, at least one of the following music generation parameters:

number of locations or positions per beat, number of beats per bar, duration of a refrain, duration of a couplet, duration of the introduction, duration of the finale, number of repeats of the elements of the pieces, the choice of orchestra, the settings of the instruments of the orchestra (overall volume), reverberation, echoes, panning, envelope, clarity of sound, etc.), the tempo, the tonality, the selection of the harmonic chords, a density associated with a location, for each location, each family of note pitches, each rule applicable or not applicable to the note pitches, the maximum pitch interval between the two pitches of consecutive notes, the intensity associated with each location, the duration of the notes, the densities associated with the locations for the arpeggios, the intensity associated with each location for the arpeggios, the duration of the arpeggio notes, the densities associated with the locations for the harmonic chords, and the intensity associated with each location for the rhythmic chords, is representative of a physical quantity coming from a sensor, in this case an image sensor.

Thus, in FIG. 7, during an operation 502, the image coming from a video camera or a camcorder is processed using image processing techniques known to those skilled in the art, in order to determine at least one of the following parameters corresponding to the position of the user's body, and preferably the position of his hands, on a monochrome (preferably white) background:

mean horizontal position of the conductor's body, hands or baton;

mean vertical position of the conductor's body, hands or baton;

range of horizontal positions (standard deviation) of the conductor's body, hands or baton;

range of vertical positions (standard deviation) of the conductor's body, hands or baton;

mean slope of the cloud of positions of the conductor's body, hands or baton; and movement of the mean vertical and horizontal positions (defining the four location in a beat and the intensities associated with these locations).

Then, during an operation 504, each parameter value determined during operation 502 is brought into correspondence with at least one value of a music generation parameter described above.

Next, during an operation 506, two elements (refrain and couplet) of a piece are generated in accordance with the associated method of music generation implementation (second or third method of implementation, illustrated in FIGS. 3 and 4).

Finally, during an operation 508, the music piece generated is played or stored in an information medium. The music generation parameters (rhythmic cadence, note pitches, chords) corresponding to a copied part (refrain, couplet, semi-refrain, semi-couplet or movement of a piece) gradually change from one musical moment to the next, while the intensities and durations of the notes change immediately in relation with the parameters picked up.

It may be seen that the embodiment of the system illustrated in FIG. 6 is tailored to carrying out the fourth method of implementing the music generation procedure of the present invention, illustrated in FIG. 7.

In the same way as explained with regard to FIGS. 5 to 7, and according to arbitrary correspondence settings, sensors of physical quantities other than image sensors may be used according to other methods of implementing the present invention. Thus, in another method of implementing the present invention, sensors for detecting physiological quantities of the user's body, such as:

an actimeter, a tensiometer, a pulse sensor, a sensor for detecting rubbing, for example on sheets or a pillow (in order to form a wake-up call following the wake-up of the user), a sensor for detecting pressure at various points on gloves and/or shoes, and a sensor for detecting pressure on arm and/or leg muscles, are used to generate values of parameters representative of physical quantities which, once they have been brought into correspondence with music generation parameters, make it possible to generate musical pieces.

In another method of implementation, not shown, the parameters representative of a physical parameter are representative of the user's voice, via a microphone. In one example of carrying out a method of implementation, a microphone is used by the user to hum part of a melody, for example a couplet, and analysis of his voice gives values of the music generation parameters directly, in such a way that the piece composed includes that part of the melody hummed by the user.

Thus, the following music generation parameters can be obtained directly by processing the signal output by a microphone:

translation into MIDI language of the notes of a melody sung;

tempo (speed of execution);

maximum pitch interval between two notes played successively;

tonality;

harmonic scale;

orchestra;

intensities of the locations;

densities of the locations;

durations of the notes.

In another method of implementation, not shown, which may or may not be associated or previous method of implementation, a text is supplied by the user and a vocal synthesis system "sings" this text to the melody.

In another method of implementation, not shown, the user uses a keyboard, for example a computer keyboard, to make all or some of the music generation parameter choices.

In another method of implementation, not shown, the values of musical parameters are determined according to the lengths of text phrases, to the words used in this text, to their connotation in a dictionary of links between text, emotion and musical parameter, to a number of feet by line, to the rhyming of this text, etc. This method of implementation is favorably combined with other methods of implementation explained above.

In another method of implementation, not shown, the values of musical parameters are determined according to graphical objects used in a design or graphics software package, according to mathematical curves, to the results in a tabling software package, to the replies to a playful questionnaire (choice of animal, flower, name, country, color, geometrical shape, object, style, etc.) or to the description of a gastronomic menu.

In another method of implementation, not shown, the values of the musical parameters are determined according to one of the following processing operations:

image processing of a painting;

image processing of a sculpture;

image processing of an architectural building;

processing of signals coming from olfactory or gustatory sensors (in order to associate a musical piece with a wine in which at least one gustatory sensor is positioned, or with a perfume).

Finally, in a method of implementation not shown, at least one of the automatic music generation parameters depends on at least one physical parameter, which is picked up by a video game sensor, and/or on a sequence of a game in progress.

Figure 9:
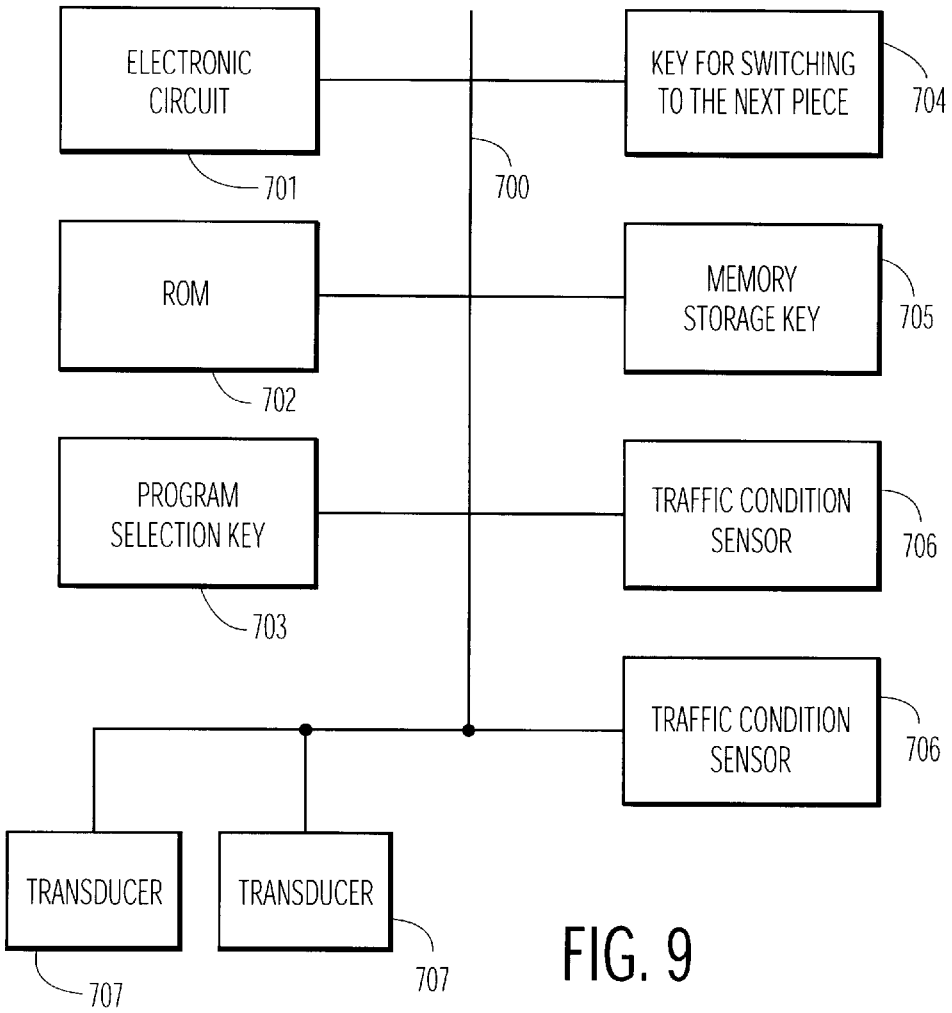
FIG. 9 shows a system suitable for implementing the flow charts illustrated in FIGS. 3, 4A, and 4B.

In a method of implementation illustrated in FIG. 9, the present invention is applied to a movable music generation system, such as a car radio or a Walkman.

This movable music generation system comprises, linked together via a data and control bus 700:

an electronic circuit 701, which carries out the operations illustrated in FIG. 3 or the operations illustrated in FIGS. 4A and 4B, in order to generate a stereophonic audio signal;

a nonvolatile memory 702;

a program selection key 703;

a key 704 for switching to the next piece;

a key 705 for storing a musical piece in the memory;

at least one sensor 706 for detecting traffic conditions; and two electroacoustic transducers 707 which broadcast the music (in the case of the application to a Walkman, these transducers are small loudspeakers integrated into earphones and in the application to a car radio, these transducers are loudspeakers built into the passenger compartment of a vehicle).

In the embodiment of the invention illustrated in FIG. 9, the key 705 for storing a musical piece in memory is used to write into the nonvolatile memory 702 the parameters of the musical piece being broadcast. In this way, the user appreciating more particularly a musical piece can save it in order to listen to it again subsequently.

The program selection key 703 allows the user to choose a program type, for example depending on his physical condition or on the traffic conditions. For example, the user may choose between three program types:

a "wake-up" program, intended to wake him up or to keep him awake, in which program the pieces are particularly rhythmic;

a "cool-driver" program intended to relax him (for example in traffic jams), in which program the pieces are calm and slower than in the "wake-up" program (and are intended to reduce the impatience connected with traffic jams); and an "easy-listening" program, mainly comprising cheerful music. The key 704 for switching to the next piece allows the user not enjoying a piece he is listening to to switch to a new piece.

Each traffic condition sensor 706 delivers a signal representative of the traffic conditions. For example the following sensors may constitute sensors 706:

a clock, which determines the duration of driving the vehicle or device since the last time it has stopped (this duration being representative of the state of fatigue of the user);

a speed sensor, linked to the vehicle's speedometer, which determines the average speed of the vehicle over a duration of a few minutes (for example, the last five minutes) in order, depending on predetermined thresholds (for example 15 km/h and 60 km/h), to determine whether the vehicle is in heavy (congested) traffic, moderate traffic (without any congestion) or on a clear highway;

a vibration sensor, which measures the average intensity of vibrations in order to determine the traffic conditions (repeated stoppages in dense traffic, high vibrations on a highway) between the pieces;

a sensor for detecting which gearbox gear is selected (frequently changing into first or second gear corresponding to traffic in an urban region or congested traffic, whereas remaining in one of the two highest gears corresponding to traffic on a highway);

a sensor for detecting the weather conditions, external temperature, humidity and/or rain detector;

a sensor for detecting the temperature inside the vehicle;

a clock giving the time of day; and more specifically suitable for a Walkman, a podometer which senses the rhythm of the walking.

Depending on the signals coming from each sensor 706 (these possibly being compared with values of previously stored signals), and if the user has not chosen a music program, this is selected by the electronic circuit 701.

Figure 8:
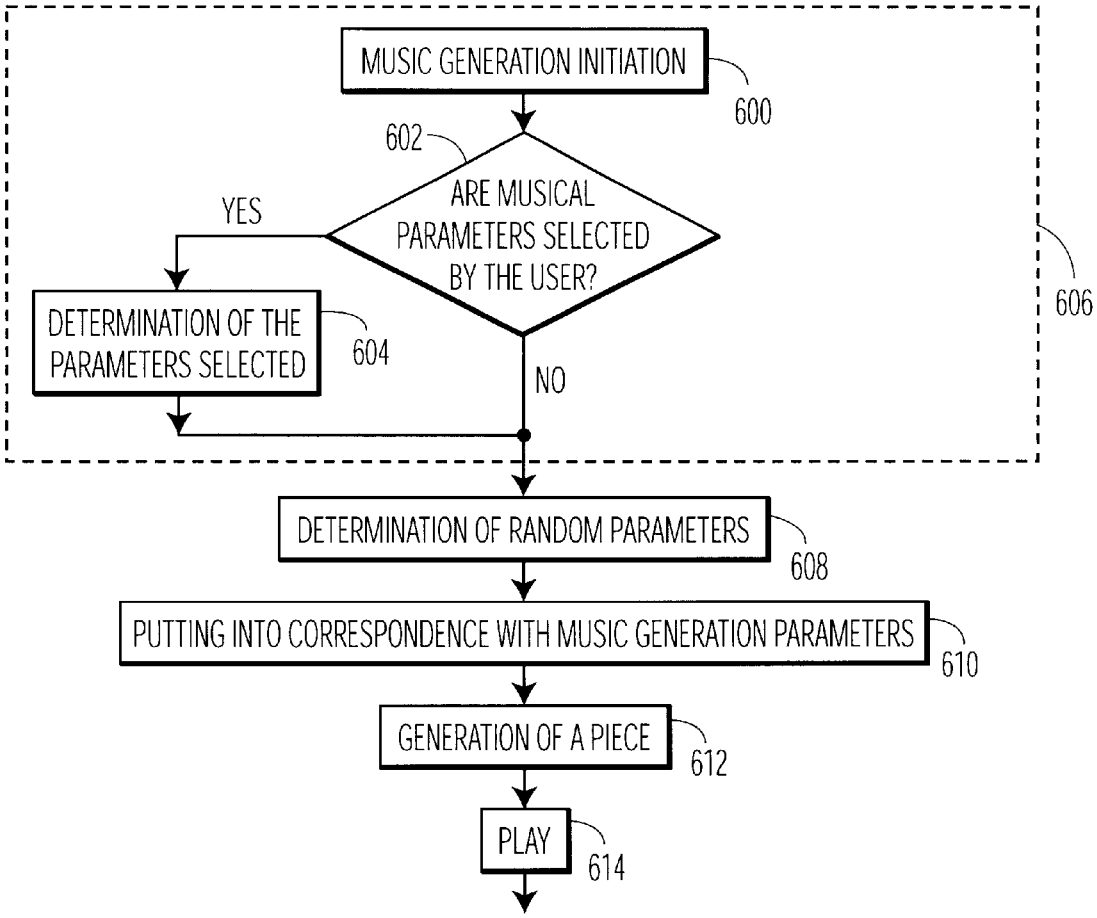
FIG. 8 shows, schematically, a flow chart for music generation according to one aspect of the present invention.

FIG. 8 shows, schematically, a flow chart for music generation according to one aspect of the present invention, in which, during an operation 600, the user initiates the music generation process, for example by supplying electrical power to the electronic circuits and by pressing on a music generation selection key.

Next, during a test 602, it is determined whether the user can select musical parameters, or not. When the result of the test 602 is positive, during an operation 604, the user has the possibility of selecting musical parameters, for example via a keyboard, potentiometers, selectors or a voice recognition system, by choosing a page of an information network site, for example the Internet network, depending on the signals emitted by sensors.

Operations 600 to 604 together constitute an initiation operation 606. When the user has selected each musical parameter that he can select or when a predetermined duration has elapsed without the user having selected a parameter, or else when the result of the test 602 is negative, during an operation 608, the system determines random parameters, including for each parameter which could have been selected but which has not yet been selected during operation 604.

During an operation 610, each random or selected parameter is put into correspondence with a music generator parameter, depending on the method of implementation used (for example one of the methods of implementation illustrated in FIGS. 3 or 4A and 4B).

During an operation 612, a piece is generated by using the musical parameters selected during operation 604 or generated during operation 606, depending on the method of implementation used. Finally, during an operation 614, the musical piece generated is played as explained above.

Figure 10:
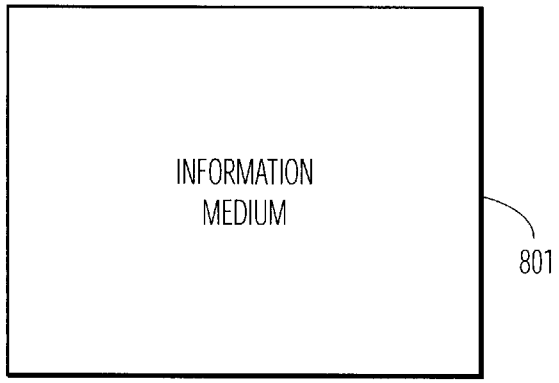
FIG. 10 shows an information medium according to one aspect of the present invention.
Figure 11:
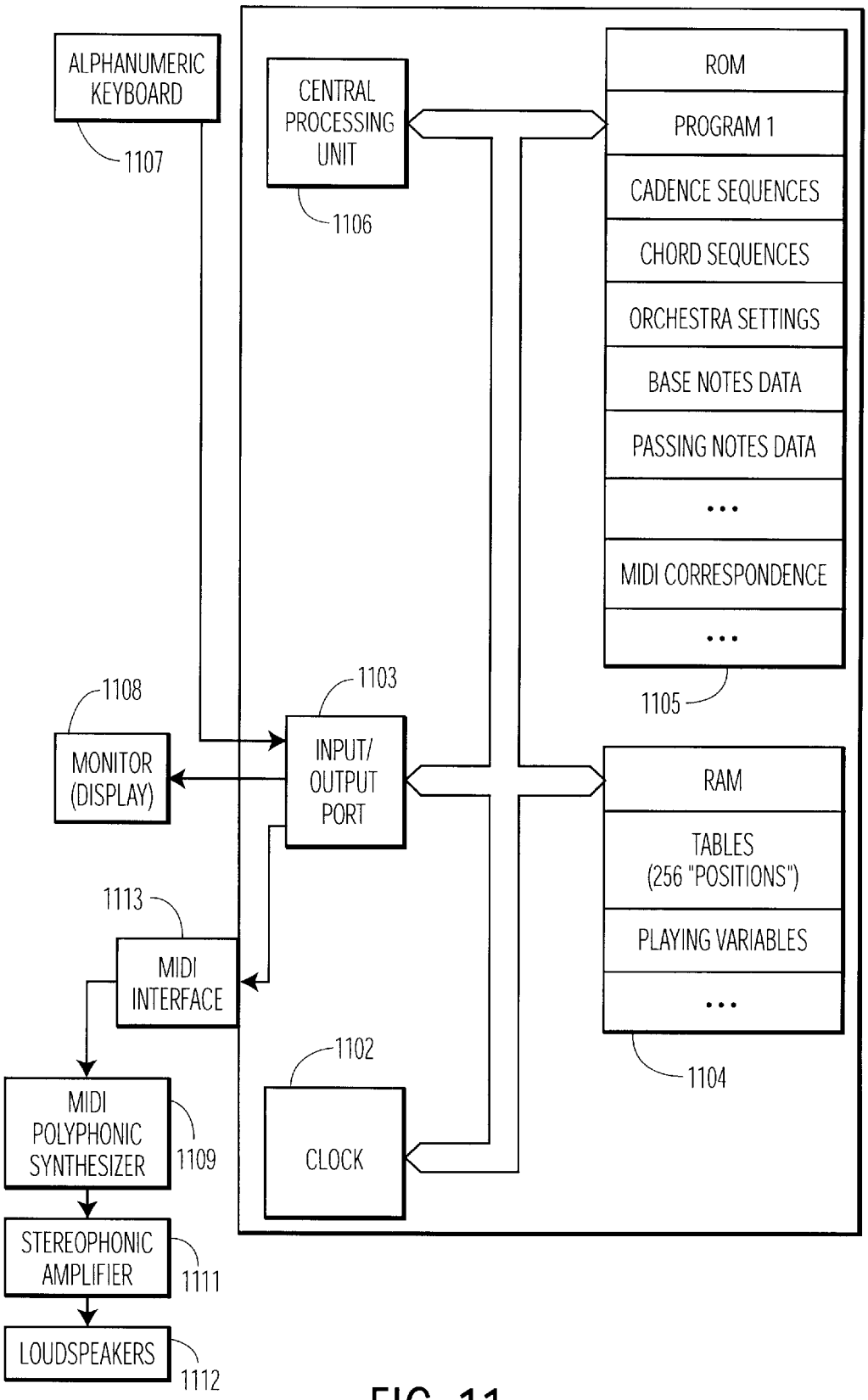
FIGS. 11 shows, schematically, a system suitable for carrying out another method of implementing the procedure forming the subject of the invention.

FIG. 10 shows a method of implementing the present invention, applied to an information medium 801, for example a compact disc (CD-ROM, CD-I, DVD, etc.). In this method of implementation, the parameters of each piece, which were explained with regard to FIGS. 3, 4A and 4B, are stored in the information medium and allow a saving of 90% of the sound/music memory space, compared with music compression devices currently used.

Likewise, the present invention applies to networks, for example the Internet network, for transmitting music for accompanying "web" pages, without transferring the voluminous "MIDI" or "audio" files; only a predetermined play order (predetermined by the "Web Master") of a few bits is transmitted to a system using the invention, which may or may not be integrated into the computer, or quite simply to a music generation (program) "plug in" coupled with a simple sound card.

In another method of implementation, not shown, the invention is applied to toilets and the system is turned on by a sensor (for example, a contact) which detects the presence of a user sitting on the toilet bowl.

In other methods of implementation, not shown, the present invention is applied to an interactive terminal (sound illustration), to an automatic distributor (background music) or to an input ringing tone (so as to vary the sound emission of these systems, while calling the attention of their user).

In another method of implementation of the present invention, not shown, the melody is input by the user, for example by the use of a musical keyboard, and all the other parameters of the musical piece (musical arrangement) are defined by the implementation of the present invention.

In another method of implementation, not shown, the user dictates the rhythmic cadence and the other musical parameters are defined by the system forming the subject of the present invention.

In another method of implementation of the present invention, not shown, the user selects the number of playing points, for example according to phonemes, syllables or words of a spoken or written text.

In another method of implementation, not shown, the present invention is applied to a telephone receiver, for example to control a musical ringing tone customized by the subscriber.

According to a variant, the musical ringing tone is automatically associated with the telephone number of the caller.

According to another variant, the music generation system is included in a telephone receiver or else located in a datacom server linked to the telephone network.

In another method of implementation, not shown, the user selects chords for generating the melody. For example, the user can select up to 4 chords per bar.

In another method of implementation not shown, the user selects a harmonic grid and/or a bar repeat structure.

In another method of implementation not shown, the user selects or plays the playing of the bass, and the other musical parameters are selected by the system forming the subject of the present invention.

In another method of implementation of the present invention, not shown, a software package is downloaded into the computer of a person using a communication network (for example the Internet network) and this software package allows automatic implementation, either via initiation by the user or via initiation by a network server, of one of the methods of implementing the invention.

According to a variant not shown, when a server transmits an Internet page, it transmits all or some of the musical parameters of the accompanying music intended for accompanying the reading of the page in question.

In a method of implementation not shown, the present invention is used together with a game, for example a video game or a portable electronic game, in such a way that at least one of the parameters of the musical pieces played depends on the phase of the game and/or on the player's results, while still ensuring diversity between the successive musical sequences.

In another method of implementation, not shown, the present invention is applied to a telephone system, for example a telephone switchboard, in order to broadcast diversified and harmonious on-hold music.

According to a variant, the listener changes piece by pressing on a key of the keyboard of his telephone, for example the star key or the hash key.

In another method of implementation, not shown, the present invention is applied to a telephone answering machine or to a message service, in order to musically introduce the message from the owner of the system.

According to a variant, the owner changes piece by pressing a key on the keyboard of the answering machine.

According to a variant not shown, the musical parameters are modified at each call.

In a method of implementation not shown, the system or the procedure forming the subject of the present invention is used in a radio, in a tape recorder, in a compact disc or audio cassette player, in a television set or in an audio or multimedia transmitter, and a selector is used to select the music generation in accordance with the present invention.

Another method of implementation is explained with regard to FIGS. 11 to 25, by way of nonlimiting example.

In this method of implementation described and shown, all the random selections made by the central processing unit 1106 relate to positive or negative numbers and a selection made from an interval bounded by two values may give one of these two values.

During an operation 1200, the synthesizer is initialized and switched to the General MIDI mode by sending MIDI-specific codes. It consequently becomes a "slave" MIDI expander ready to be read and to carry out orders.

During operations 1202 and 1204, the central processing unit 1106 reads the values of the constants, corresponding to the structure of the piece to be generated, and stored in the read-only memory (ROM) 1105, and then transfers them to the random-access memory (RAM) 1104.

In order to define the internal structure of a beat (FIG. 12, 1150), the value 4 is given for the maximum number of possible locations to be played per beat, 4 locations called "e1", "e2", "e3" and "e4" (terminology specific to the invention). Each beat of the entire piece has 4 identical locations. Other modes of application may employ a different value or even several values corresponding to binary or ternary divisions of the beat. Example, for a ternary division of the beat: 3 locations per beat, i.e. 3 quavers in triplets in a 2/4 bar, 4/4 bar, 6/4 bar, etc., or 3 crotchets in triplets in a 2/2 bar, 3/2 bar, etc. This therefore gives only 3 locations, "e1", "e2" and "e3", per beat. The number of these locations determines certain of the following operations.

Figure 12:
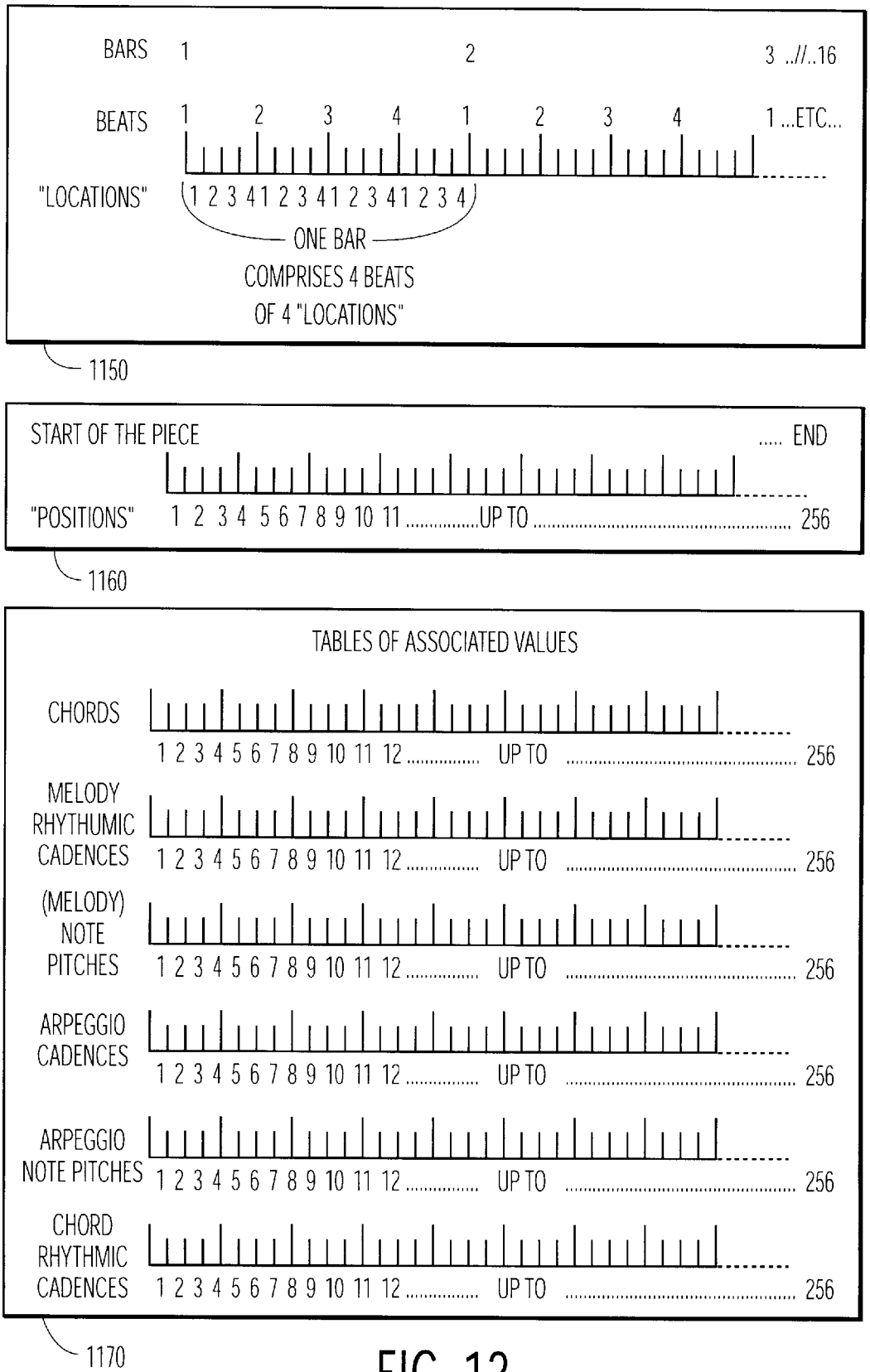
FIG. 12 shows internal structures of beats and of bars, together with tables of values, used to carry out the method of implementation using the system of FIG. 11.
Figure 13:
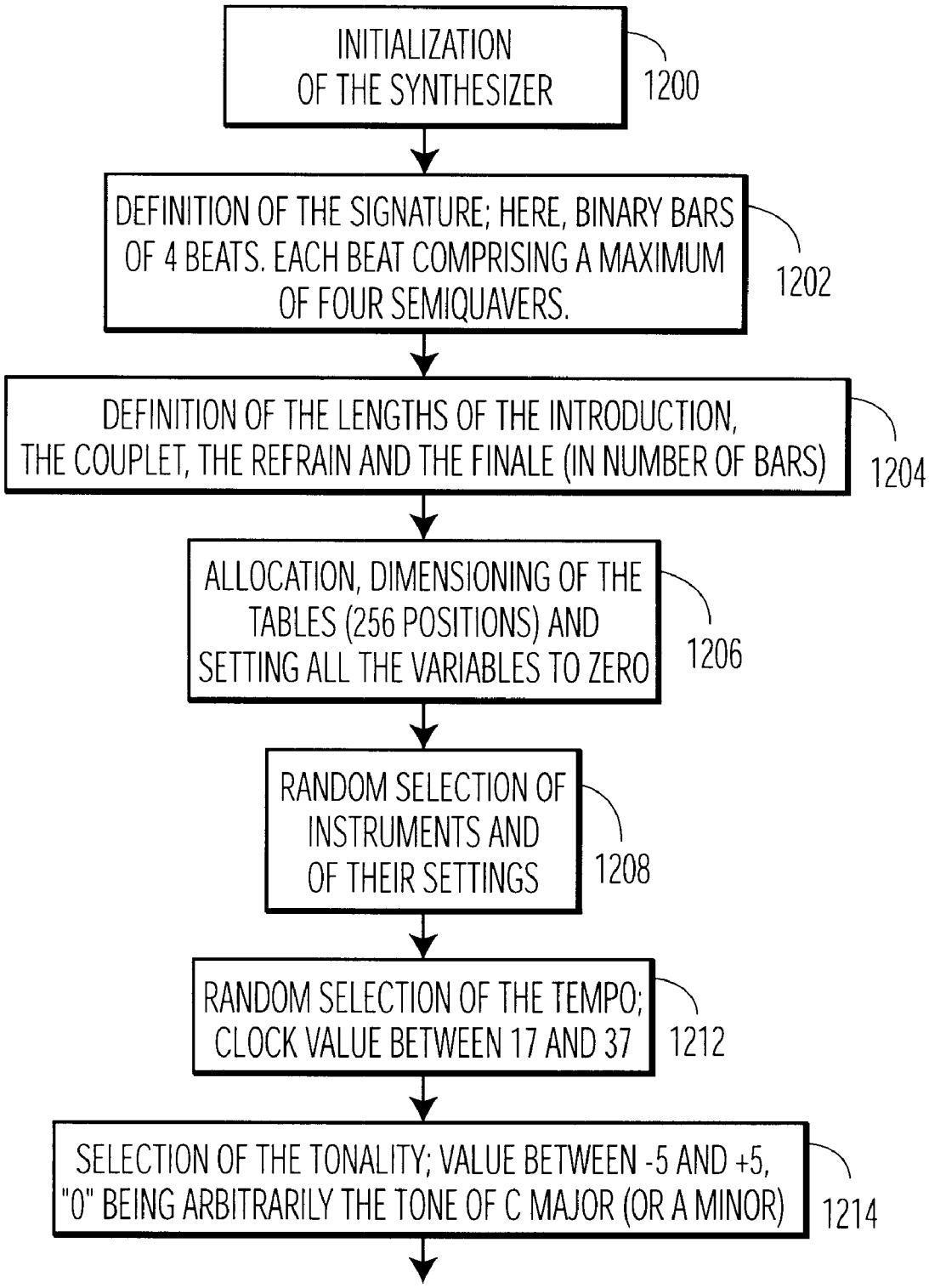
FIGS. 13 to 23 show a flow chart for the method of implementation corresponding to FIGS. 11 and 12.
Figure 14:
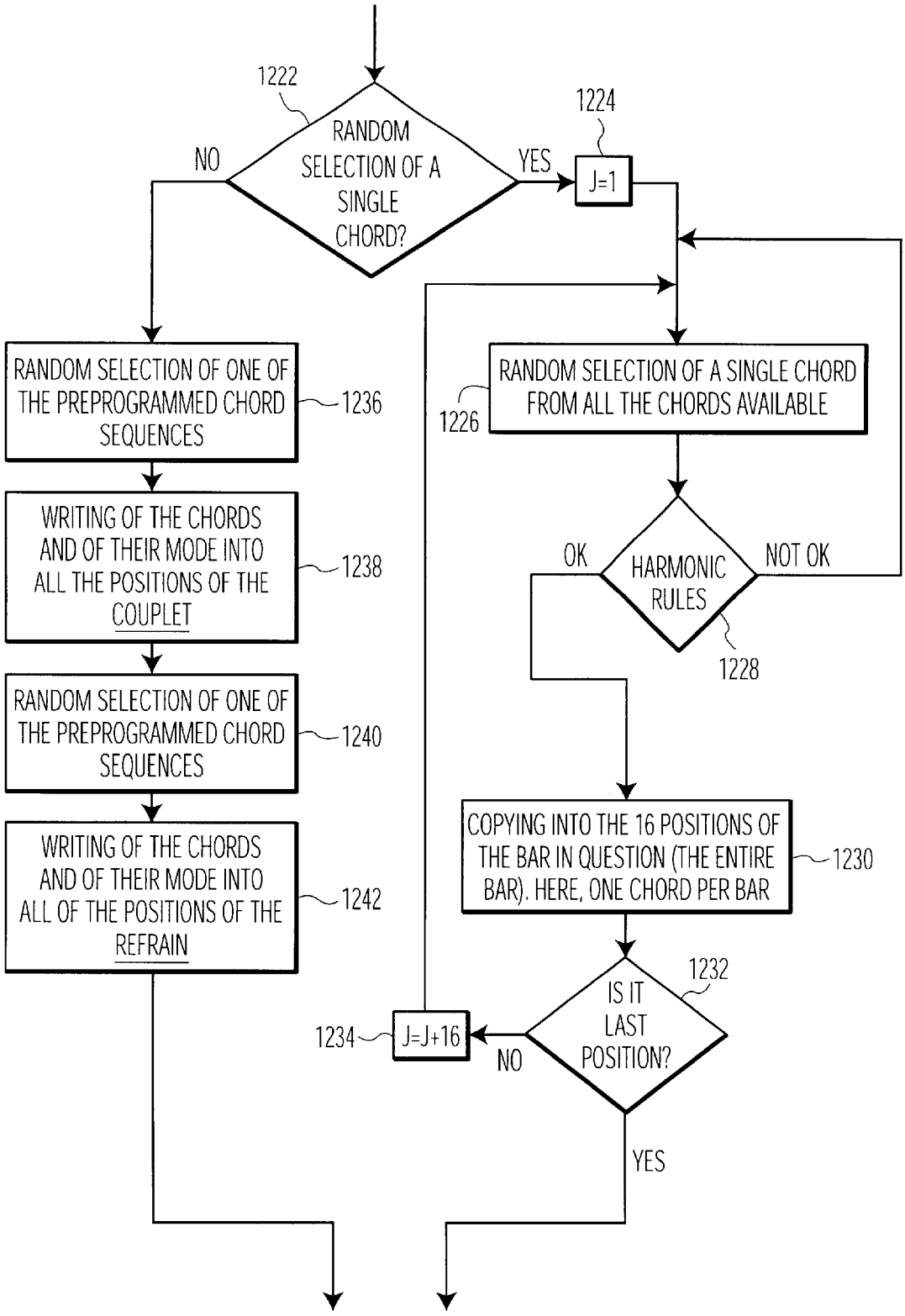

Again during operation 1202, the central processing unit 1106 also reads the constant value 4, corresponding to the internal structure of the bar (FIG. 12, 1150, 1160). This value defines the number of beats per bar.

Thus, the overall structure of the piece will be composed of 4-beat bars (4/4), where each beat may contain a maximum of 4 semiquavers, providing 16 (4×4) positions of notes, of note duration or of rests per bar. This simple measurement choice is decided arbitrarily in order to make it easier to the reader to understand.

During operation 1204, the central processing unit 1106 reads values of constants corresponding to the overall structure of the piece (FIG. 13, 1204) and more specifically to the lengths, in terms of bars, of the "moments". Couplet and refrain each receive a length value in terms of beats equal to 8. Couplet and refrain therefore represent a total of 16 bars of 4 beats each containing 4 locations. That is a total of time units or "positions" of 16×4×4=256 positions.

Also read are the values corresponding to the number of repeats of the "moments" during the playing phase. During the playing phase, the introduction will be the reading and the playing of the first two bars of the couplet, played twice—the "couplet and refrain" will each be played twice and the finale (coda) will be the repeat of the refrain, these arbitrary values possibly being, in other modes of application, different or the same, between random imposed limits.

During operations 1202 and 1204, and after each reading of the constants stored in the read-only memory (ROM) 1105, the central processing unit 1106 transfers these structure values into the random-access memory (RAM) 104.

During an operation 1206, the central processing unit 1106 reserves tables of associated variables (within the beat) and of allocation of tables of whole numbers, each table being composed of 256 entries, corresponding to the 256 positions of the piece (J=1 to 256). The values possibly reserved by each table are set to zero (for the case in which the program is put into a loop so as to generate continuous music). The main tables thus reserved, allocated and initialized are (FIG. 12, 1170):

the harmonic chord table;

the melody rhythmic cadence table;

the melody note pitch table;

the melody note length (duration) table;

the melody note intensity table;

the arpeggio note rhythmic cadence table;

the arpeggio note pitch table;

the arpeggio note intensity table;

the rhythmic chord rhythmic cadence table;

the rhythmic chord intensity table.

Then, during an operation 1208, the central processing unit 1106 makes a random orchestra selection from a set of orchestras composed of instruments specific to a given musical style (variety, classical, etc.), this orchestra value being accompanied by values corresponding to:

the type of instrument (or sound);

the settings of each of these instruments (overall volume, reverberation, echoes, panning, envelope, clarity of sound, etc.), which determines the following operations.

These values are stored in memory in the "instrumentation" register of the random-access memory 1104.

Next, during an operation 1212, the central processing unit 1106 randomly selects the tempo of the piece to be generated, in the form of a clock value corresponding to the duration of a time unit ("position"), that is to say, in terms of note length, of a semiquaver expressed in $1/200^{th}$ of a second. This value is selected at random between 17 and 37. For example, the value 25 corresponds to a crochet duration of $4\times 25/200^{th}$ of a second=½ second, i.e. a tempo of 120 to the crotchet. This value is stored in memory in the "tempo" register of the random-access memory 1104.

The result of this operation has an influence on the following operations, the melody and the musical arrangement being denser (more notes) if the tempo is slow, and vice versa.

Then, during an operation 1214, the central processing unit 1106 makes a random selection between −5 and +5. This value is stored in memory in the "transposition" register of the random-access memory 1104.

The transposition is a value which defines the tonality (or base harmony) of the piece; it transposes the melody and its accompaniment by one or more semitones, upward or downward, with respect to the first tonality, of zero value, stored in the read-only memory.

The base tonality of value "0" being arbitrarily C major (or its relative minor, namely A minor).

During an operation 1220, the central processing unit makes a binary selection and, during a test 1222, determines whether the value selected is equal to "1" or not. When the result of the test 1222 is negative, one of the preprogrammed sequences of 8 chords (1 per bar) is selected from the read-only memory 1105—operations 1236 to 1242. If the result of the test 1222 is positive, the chords are selected, one by one, randomly for each bar—operations 1224 to 1234.

During operation 1236, the central processing unit randomly selects two numbers between "1" and the "total number" of preprogrammed chord sequences contained in the "chord" register of the read-only memory 1105. Each chord sequence comprises eight chord numbers, each represented by a number between 0 and 11 (chromatic scale, semitone by semitone, from C to B), alternating with eight mode values (major=0, minus=1).

For example, the following sequence of 8 chords and 8 modes:

9, −1, 4, −1, 9, −1, 4, −1, 7, 0, 7, 0, 0, 0, 0, 0 corresponds to the table below:

| Chords | A min | E min | A min | E min | G | G | C | C |
|---|---|---|---|---|---|---|---|---|
| Values | 9 | 4 | 9 | 4 | 7 | 7 | 0 | 0 |
| Maj/min | −1 | −1 | −1 | −1 | 0 | 0 | 0 | 0 |

In this table, in the "Maj/min" row, each major chord is represented by a zero and each minor chord by "−1".

It will be seen later, during operation 1411, that a table of chord inversions, whose values are 1, 2 and 3, is associated with each chord sequence.

During an operation 1238, these various values are written and distributed in the chord table at the positions corresponding to the length of the couplet (positions 1 to 128).

During an operation 1240, a procedure identical to operation 1236 is carried out, but this time for the refrain.

During an operation 1242, these various values are written and distributed in the chord table at the positions corresponding to the length of the refrain (positions 129 to 256).

When the result of the test 1222 is positive, the central processing unit 1106 randomly selects a single preprogrammed chord from the read-only memory 1105 and then, during operation 1228 and starting from position 17 (J=17), compares the chord selected with the chord of the previous bar (J=J−16). The chord compared is accepted or rejected according to the rules of the art (adjacent tones, relative minors, dominant seventh chords, etc.). If the chord is rejected, during an operation 1226 a new chord selection is made only for the same position "J" until the chord is accepted. Next, during operation 1230, the chord value is copied, together with its mode and inversion values, from the random-access memory in the chord table, into the 16 positions of the current bar.

Each bar is thus processed in increments of 16 positions, carried out by operation 1234. The test 1232 checks whether the "J" position is not the last position of the piece (J=(256−16)+1), i.e. the first position of the last bar.

Operation 1230, on the one hand, and operations 1238 and 1242, on the other hand, make it possible, in the rest of the execution of the flow chart, to know the current chord at each of the 256 positions of the piece.

In general, these operations relating to the chords of the piece to be generated may be shown schematically:

An operation of randomly selecting preprogrammed chord sequences intended for each of the two fundamental moments: couplet then refrain.

An operation of randomly selecting chords from available chords, for each bar, according to the constraints of the rules of the art, the choice of one or other of the above two operations itself being random.

It should be mentioned here that the method of implementation described and shown generates musical pieces of the "song" or "easy listening" style, the available chords are also intentionally limited to the following chords: perfect minors, perfect majors, diminished chords, dominant sevenths, elevenths. The harmony (chord) participates in the determination of the music style. Thus, to obtain a "Latin-American" style, for example, requires a library of chords comprising major sevenths, augmented fifths, ninths, etc.

Figure 15:
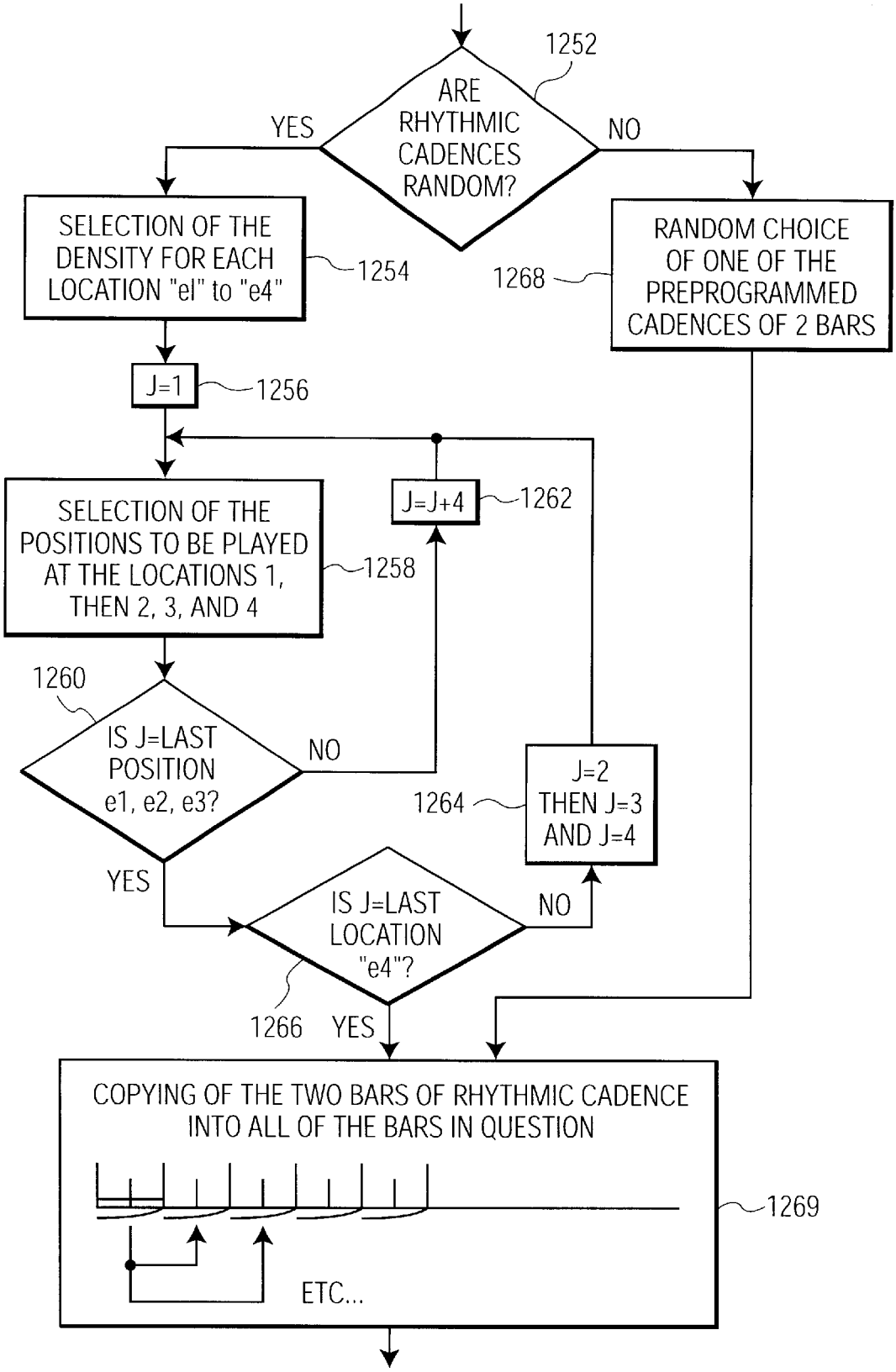

FIG. 15 combines the operations of randomly generating one of the three rhythmic cadences of two bars, each one distributed over the entire piece, determining the positions of the melody notes to be played and more precisely the positions of the starts ("notes-on") of the note to be played of the melody, the other positions being consequently rests, note durations or ends of note duration (or "notes-off", described later in "duration of the notes").

Example of a rhythmic cadence of two 4/4 bars, i.e. of 32 positions:

| Bars: | 1 | | | | 2 | | | |
|---|---|---|---|---|---|---|---|---|
| Beats: | 1 | 2 | 3 | 4 | 1 | 2 | 3 | 4 |
| Locations: | 1234 | 1234 | 1234 | 1234 | 1234 | 1234 | 1234 | 1234 |
| Positions to be played: | 1000 | 1010 | 0000 | 1000 | 1000 | 0000 | 1110 | 0000 |

The row of the positions to be played represent the rhythmic cadence, the number "1" indicating the position which will later receive a note pitch and the number "0" indicating the positions which will receive rests, or, as we will see later, note durations (or lengths), and "notes-off".

The couplet receives the first two cadences repeated 2 times and the refrain receives the third cadence repeated 4 times.

The operation of generating a rhythmic cadence is carried out in four steps so as to apply a density coefficient specific to each location ("e1" to "e4") within the beat of the bar. The values of these coefficient determine, consequently, the particular rhythmic cadence of a given style of music.

For example, a density equal to zero, and applied to each of the locations "e2" and "e4" consequently produces a melody composed only of quavers at the locations "e1" and "e3". On the other hand, a maximum density applied to the four locations consequently produces a melody composed only of semiquavers at the locations "e1", "e2", "e3" and "e4" (general rhythmic cadence of a fugue).

Selection of the random rhythmic cadences of the melody, that is to say selection of the "positions to be played" within the (universal) beat at locations "e1" to "e4" takes place in an anticipatory manner, in this case by increments of four in 4 positions:

in a first beat, it is necessary to deal with the positions at the locations "e1"

positions 1, 5, 9, 13, . . . up to 253;

in a second beat, the positions at the locations "e3"

positions 3, 7, 11, 15, . . . up to 255;

next, indiscriminately, the other locations "e2" and "e4"

positions 2, 6, 10, 14, . . . up to 254;

positions 4, 8, 12, 16, . . . up to 256.

The positions are therefore not treated chronologically except, obviously, during the first treatment of the positions at "e1". This makes it possible, for the following selections (in the order: positions "e3", "e2" and "e4"), to know the previous time adjacency (the past) and the next time environment (the future) of the note to be treated (except at "e1" where only the previous one is known from the second one to be selected).

Knowing the past and the future of each position will determine the decisions to be taken for the various treatments at "e3", "e2" and then "e4" (the presence or absence of a note at the preceding and following locations determining the existence of the note to be treated and, later on, the same principle will be applied to the selection of the note pitches in order to deal with the intervals, doublets, durations, etc.).

Here, the beat is divided into four semiquavers, but this principle remains valid for any other division of the beat.

EXAMPLE

In the present method of implementation, the existence of a note at the locations "e2" and "e4" is determined by the presence of a note, either at the previous position or at the following position. In other words, if this position has no immediate adjacency, either before or after, it cannot be a position to be played and will be a rest position, note-duration position or note-off position.

In the method of implementation described and shown, the various cadences have a length of two bars and there are therefore eight possible locations ("e1" to "e4") of notes to be played:

the locations "e1" of the first part of the couplet have a density allowing a minimum number of 2 notes for two bars and a maximum number of 6 notes for two bars;

the locations "e3" of the first part of the couplet have a density allowing a minimum number of 5 notes for two bars and a maximum number of 6 notes for two bars;

the locations "e2" and "e4" of the first part of the couplet have a very low density, namely 1 chance in 12 of having a note at these locations;

the locations "e1" of the second part of the couplet have a density allowing a minimum number of 5 notes for two bars and a maximum number of 6 notes for two bars;

the locations "e3" of the second part of the couplet have a density allowing a minimum number of 4 notes for two bars and a maximum number of 6 notes for 2 bars;

the locations "e2" and "e4" of the second part of the couplet have a very low density, namely 1 chance in 12 of having a note at these locations;

the locations "e1" of the (entire) refrain have a density allowing a minimum number of 6 notes for two bars and a maximum number of 7 notes for two bars;

the locations "e3" of the refrain have a density allowing a minimum number of 5 notes for two bars and a maximum number of 6 notes for two bars;

the locations "e2" and "e4" of the refrain have a very low density, namely 1 chance in 14 of having a note at these locations.

This density option consequently produces a rhythmic cadence of the "song" or "easy listening" style. The density of the rhythmic cadence is inversely proportional to the speed of execution (tempo) of the piece; in addition, the faster the piece the lower the density.

If the test 1278 is positive, a binary selection is made during an operation 1250. If the result of the selection is positive, the rhythmic cadences of the melody are generated according to the random mode.

During an operation 1254, the density is selected for each location "e1" to "e4" of one of the three cadences of two bars to be generated (two for the couplet and only one for the refrain). The counter "J" of the positions is initialized to the first position (J=1) during operation 1256, so as firstly to treat the positions at the locations "e1".

Next, during an operation 1258, a binary selection ("0" or "1") is made so as to determine whether this "J" position has to receive a note or not. As mentioned above, the chances of obtaining a positive result are higher or lower depending on the location in the beat (here "e1") of the position to be treated. The result obtained ("0" or "1") is written into the melody rhythmic cadence table at the position J.

If the result of the test 1260 is negative, that is to say there remain positions at the locations "e1" in the cadence of two current bars, J is incremented by the value "4" in order to "jump" to the next position "e1".

If the result of the test 1260 is positive, the test 1266 checks whether all the positions of all the locations have been treated. If this test 1266 is negative, an operation 1264 initializes the position J according to the new location to be treated. In order to treat the locations "e1", J was initialized to 1, and in order to handle the locations "e3", the initialization is the locations "e2", the initialization is the locations "e4", the initialization is J=4.

Thus, the loop of operations 1254, 1256, 1258, 1206 and 1266 is carried out as long as the test 1266 is negative.

This same process is employed for each of the 3 cadences of two bars (two for the couplet and one for the refrain).

If the result of the test 1252 is negative, an operation 1268 randomly selects one of the cadences of two bars, preprogrammed in the read-only memory 1105.

This same process is employed for each of the 3 cadences of two bars (two for the couplet and one for the refrain).

If the result of the test 1266 is positive, an operation 1269 copies the 3 rhythmic cadences obtained into the entire piece in the table of rhythmic cadences of the melody:

the first cadence of two bars (i.e. 32 positions) is copied twice into the first four bars of the piece. At this stage, half the couplet is treated, i.e. 64 positions;

the second cadence of two bars (i.e. 32 positions) is reproduced twice over the next four bars. At this stage, the entire couplet is treated, i.e. 128 positions;

the third and final cadence of two bars (i.e. 32 positions) is reproduced 4 times over the next eight bars. At this stage, all of the couplet and of the refrain have been treated, i.e. 256 positions.

Next, during operations 1270 to 1342, the note pitches are selected at the positions defined by the rhythmic cadence (positions of notes to be played).

A note pitch is determined by five principal elements:

the overall basic harmony;

the chord associated with the same position of the piece;

its location ("e1" to "e4") within the beat of its own bar;

the interval which separates it from the previous note pitch, and in the next note; and its possible immediate adjacency (presence of a note in the previous position or (and) next position.

In addition, as was carried out during the selection of the rhythmic cadence of the melody, an anticipatory selection of the note pitches of the melody is made, in part. The positions of notes to be played over the entire piece, which are defined by the (above) rhythmic cadence of the melody, are not treated chronologically:

an operation of generating two "families of notes" is formed:

a first family of notes called "base notes" which is formed by the notes making up the chord "associated with the position" of the note to be treated and a family of notes called "passing notes" consisting of the notes of the scale of the overall base harmony (current tonality) reduced or not by the notes making up the chord associated with the position of the note to be treated.

In the method of implementation described and shown, the family of passing notes consists of the notes of this scale is reduced by the notes making up the associated chord so as to avoid successive repetitions of the same note pitches (doublets).

For example, in the scale of C, the notes underlined makeup the chord of F and form the family of base notes. The other notes form the family of passing notes: A, B, C, D, E, F, G, A, B, C, D, E, F, etc.

In the method of implementation described and shown, and apart from exceptions described above, the melody consists of an alternation of passing notes and of base notes.

H3/Selection of the note pitches of the melody (FIGS. 16 to 19).

For a clearer understanding by the reader, what is repeated below is only the note pitches at the positions to be played, these being defined by the rhythmic cadence of the melody, and the selections are random. There is obviously no anticipation during the first selection of each of the two following operations.

A first operation (FIG. 16) of anticipating the selection of the note pitches from the family of "base notes", where only the positions placed at the start of the beat ("e1") are treated (positions 1, 5, 9, 13, 17, etc.).

A second operation (FIG. 17) of anticipating the selection of the note pitches from the family of "passing notes", where only the positions placed at the "half-beat" ("e3") are treated (positions 3, 7, 11, 15, 19, etc.).

Figure 24:
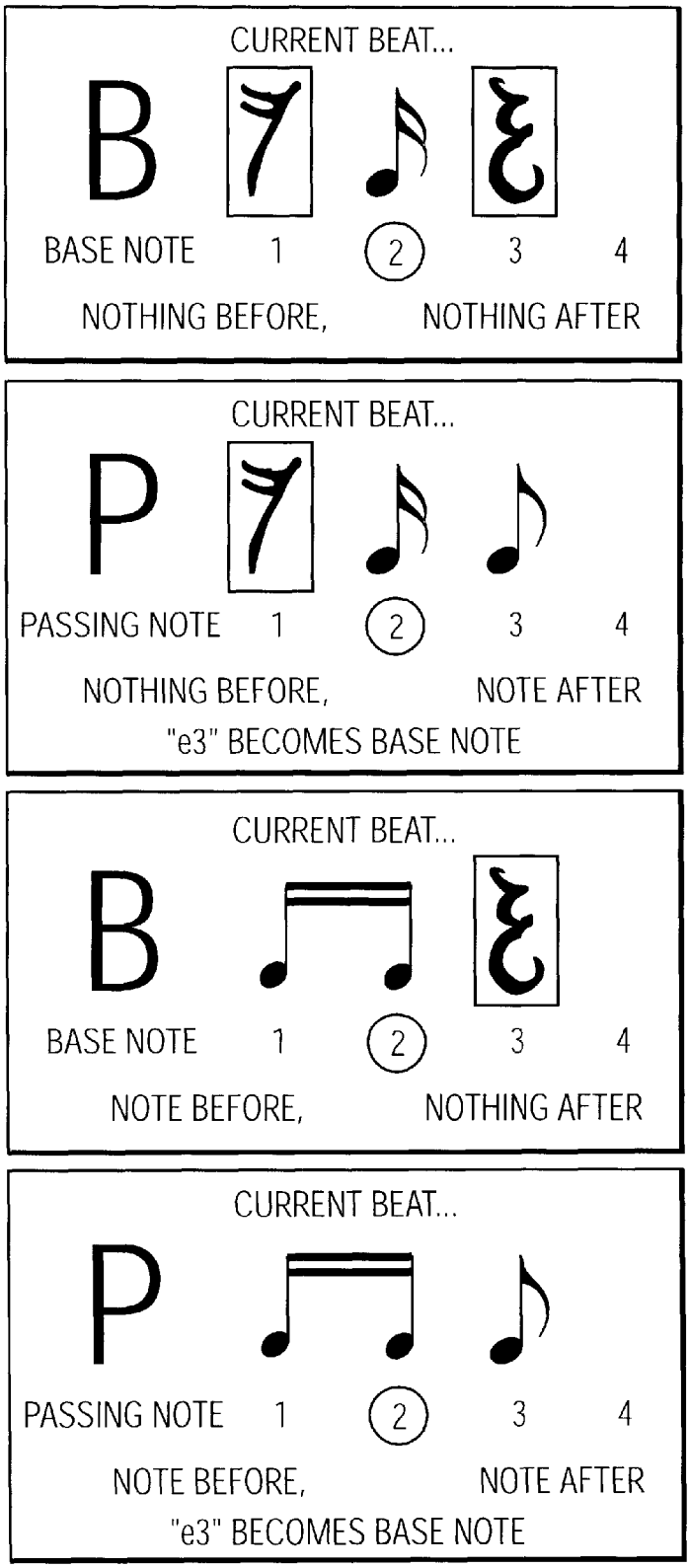
FIGS. 24 and 25 illustrate criteria for determining the family of notes at certain locations according to their immediate adjacency, for carrying out the method of implementation illustrated in FIGS. 11 and 23.

A third operation (FIG. 18) of selecting the note pitches at the locations "e2" (positions 2, 6, 10, 14, 18, etc.). This selection is made from one or other family depending on the possible previous adjacency (note or rest) at "e1" and (or) the following one at "e3" (FIG. 24). Depending on the case, this selection may cause a change in the family of the next note at "e3" so as to comply with the base note/passing note alternation imposed here (FIG. 24).

Figure 25:
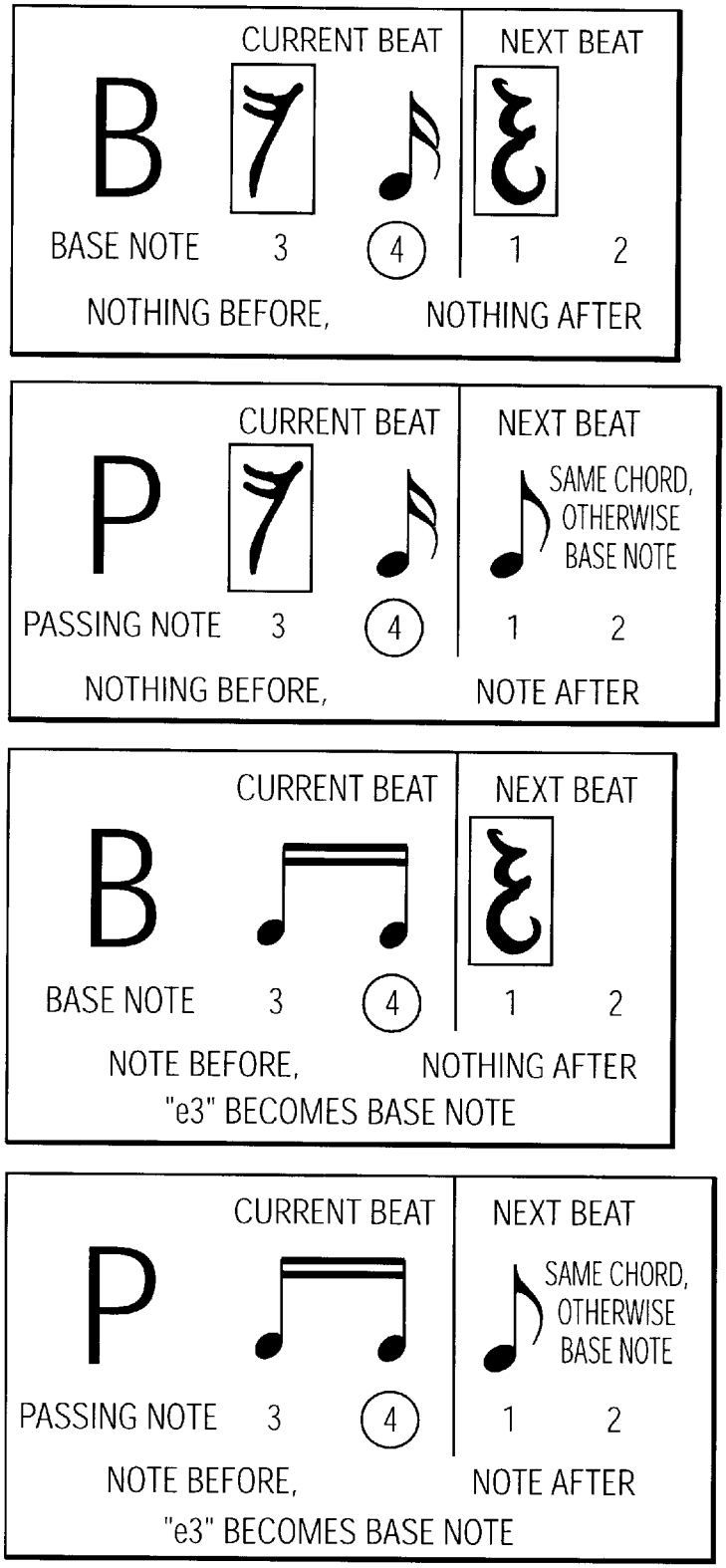

A fourth operation (FIG. 19) of selecting note pitches at the locations "e4" (positions 4, 8, 12, 16, 20, etc.). This selection is made from one or other family depending on the possible previous adjacency (note or silence) at "e3" and (or) the next one at "e1" (FIG. 24). Depending on the case, this selection may cause a change in the family of the previous note at "e3" so as to comply with the base note/passing note alternation imposed here (FIG. 25).

Exceptions to the base note/passing note alternation:

the last note of a musical phrase is selected from the family of base notes, whatever are the location ("e1" to "e4") within the beat of the current bar (FIG. 20), here a note at the end of a phrase is regarded as if it is followed by a minimum of 3 positions of rests (without a note);

the note at "e4" is selected from the family of base notes if there is a chord change at the next position at "e1".

For certain styles (e.g. American variety, jazz), a passing note representing a second (note D of the the melody with, in the accompaniment, a common chord of C major) at the location "e1" is acceptable (even if the chord is a perfect chord of C major) whereas in the method of implementation (song style) described and shown, only the base notes are acceptable at "e1".

Figure 16:
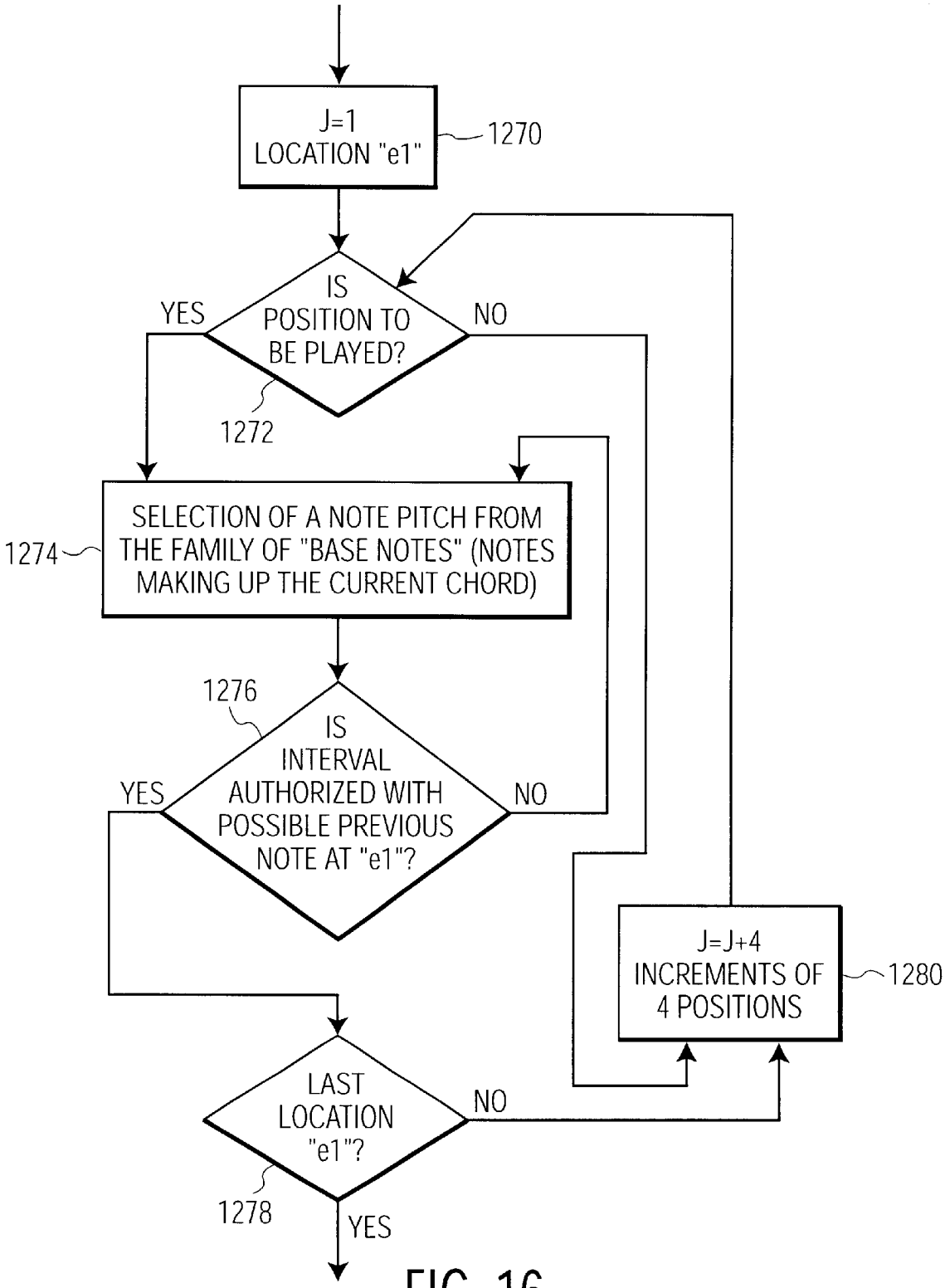

The operations and tests in FIG. 16 relate to the selection of the notes to be played at the locations "e1" and, as previously, in the selection of the rhythmic cadences, the treatment of the positions in question is carried out in increments of 4 positions (positions 1, then 5, then 9, etc.).

During an operation 1270, the "J" position indicator is initialized to the position "1", and then during the test 1272 the central processing unit 1106 checks, in the melody rhythmic cadence table, if the "J" position corresponds to a note to be played.

If the test 1272 is positive, after having read the current chord (at this same position J), the central processing unit 1106 randomly selects one of the note pitches from the family of base notes.

It is recalled that the positions at the locations "e1" receive only notes of the base family, except in the very rare exception already described.

During a test 1276, and obviously based on the second position to be treated, the central processing unit 1106 checks if the previous location ("e1") is a position of a note to be played. If this is the case, the interval separating the two notes is calculated. If this interval (in semitones) is too large, the central processing unit makes a new selection at 1274 for the same position J.

The maximum magnitude of an interval allowed between the notes of the locations "e1" has here a value of 7 semitones.

If the test 1276 is positive, the note pitch is placed in the note pitch table at the position J. Next, the test 1278 checks whether "J" is the last location "e1" to be treated. If this is not the case, the variable "J", corresponding to the position of the piece, is incremented by 4 and the same operations 1272 to 1278 are carried out for the new position.

If the test 1272 is negative (there is no note at the position "J"), "J" is incremented by 4 (next position "e1" ) and the same operations 1272 to 1278 are carried out for the new position.

Figure 17:
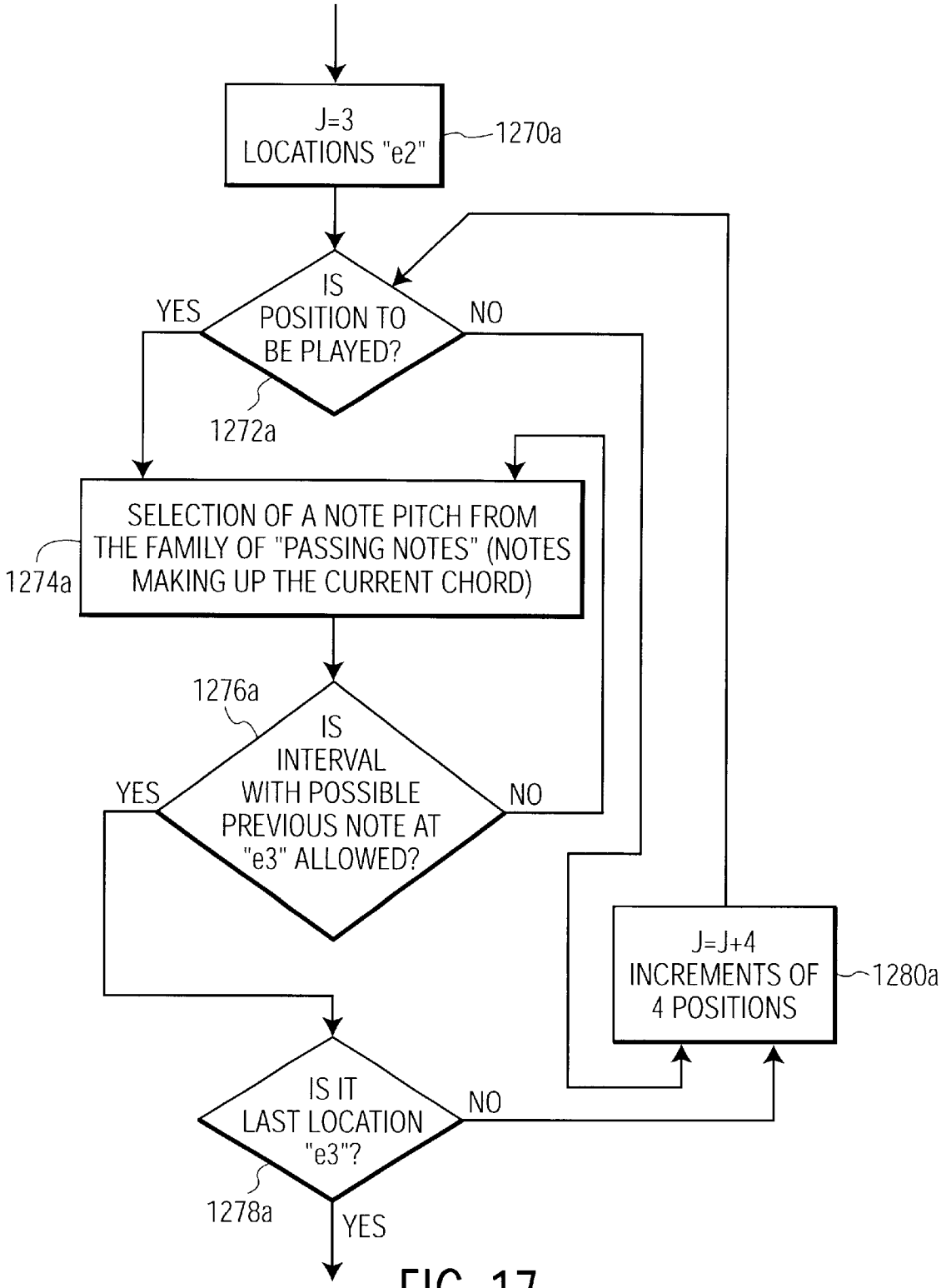

The operations and tests in FIG. 17 relate to the selection of the notes to be played at the locations "e3" and thus, as previously, in the selection at the locations "e1", the positions in question are treated in increments of 4 positions (position 3, then position 7, then position 11, etc.).

During an operation **1270*a*, the "J" position indicator is initialized to the position "3" and then, during the test 1272*a*, the central processing unit 1106** checks in the table of rhythmic cadences for the melody, whether the position "J" corresponds to a note to be played.

If the test **1272*a* is positive, after having read the current chord (at this same position J) and the scale of the base harmony (tonality) in order to form the family of passing notes which was described above, the central processing unit 1106** randomly selects one of the note pitches from the family of passing notes.

The positions at the locations "e3" receive notes of the passing family, given the very low density of the "e2" and "e4" passing notes in this method of implementation (in the song style).

These notes at "e3" will possibly be corrected later, during selections relating to the positions at the locations "e2" and "e4" (FIGS. 24 and 25).

For other music styles, such as a fugue for example, the densities of the four locations is very high, this having the effect of generating a note to be played per location ("e1" to "e4"), i.e. four semiquavers per beat for a 4/4 bar. In this case, in order to comply with the alternation imposed in the method of implementation described and shown (base note then passing note), the note pitches at the locations "e3" would be selected from the family of base notes:

"e1"=base note, "e2"=passing note,

"e3"=base note, "e4"=passing note.

In the method of implementation described and shown (in which the notes, at the locations "e2" and "e4" of the beat, are very rare given the density chosen), the family of passing notes is chosen for the notes to be played at the locations "e3" since usually the result of the selections is as follows for each beat:

"e1"=base note "e2"=rest, "e3"=passing note, "e4"=rest.

And so on; there is indeed an alternation of base notes and passing notes imposed by the method of implementation described and shown.

During a test **1276*a*, the central processing unit 1106 looks for the previous position to be played ("e1" or "e3") and the note pitch at this position. The interval separating the two notes is calculated. If this interval is too large, the central processing unit 1106 makes a new selection at 1274*a*** for the same position J.

The maximum allowed magnitude of the interval between the notes of the locations "e3" and their previous note has here a value of 5 semitones.

If the test **1276*a* is positive, the note pitch is placed in the table of note pitches at the position J. The test 1278*a* then checks whether "J" is the last location "e3" to be treated. If this is not the case, the variable "J" corresponding to the position of the piece is incremented by four and the same operations 1272*a* to 1278*a*** are carried out for the new position.

If the test **1272*a* is negative (there is no note at the position "J"), "J" is incremented by 4 (next position "e1") and the same operations 1272*a* to 1278*a*** are carried out at the new position.

Figure 18:
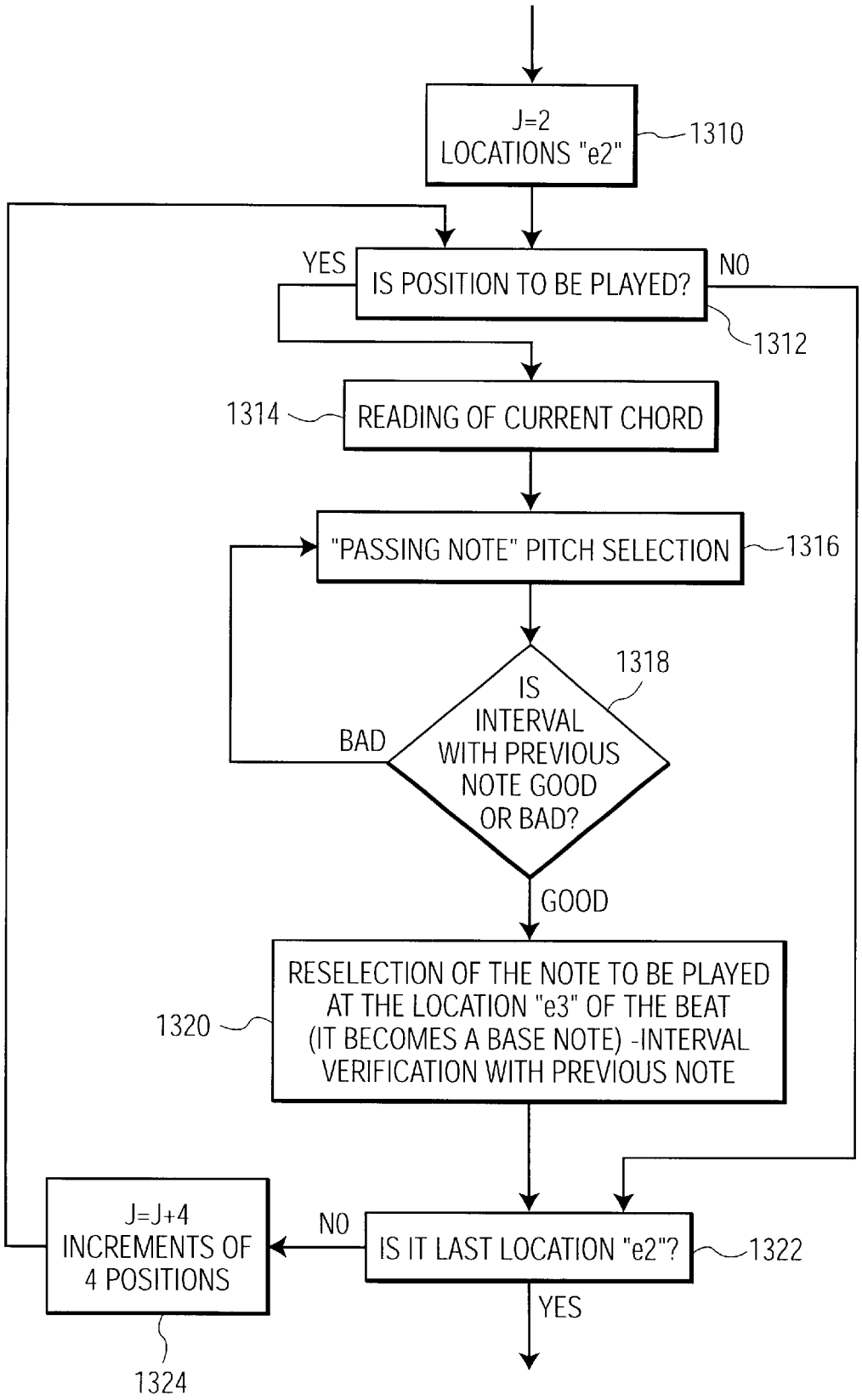

The operations in FIG. 18 relates to the selection of the notes to be played at the locations "e2". As previously, in the selection at the locations "e1" and then "e3", the positions in question are treated in increments of 4 positions (position 2, then position 6, then position 10, etc.).

During an operation 1310, the "J" position indicator is initialized to the position "2" and then, during the test 1312, the central processing unit 1106 checks in the table of rhythmic cadences for the melody whether the position "J" corresponds to a note to be played.

If the test 1312 is positive, during an operation 1314, the central processing unit reads, from the table of chords at the position "J", the current chord and the scale of the base harmony (tonality). The central processing unit 1106 then randomly selects one of the note pitches from the family of passing notes.

The positions at the locations "e2" always receive notes of the passing family, except if:

- they are isolated, that is to say without a note immediately in front of it (past note) and without a note immediately after it (future note);
- there is not not a note to be played and placed at the next (future) position at "e3".

In these cases, the locations "e2" receive base notes. Again here, the advantage of the anticipatory selection procedure may be seen.

The presence of a note to be played at "e2" implies the correction of the next and immediately adjacent note at "e3" (FIG. 24).

The central processing unit 1106 looks for the previous position to be played ("e1" or "e3") and the note pitch at this position. The interval separating the previous note from the note in the process of being selected is calculated. If this interval is too large, the test 1318 is negative. The central processing unit 1106 then makes, during an operation 1316, a new selection at the same position J.

The maximum allowed magnitude of the interval between the notes of the locations "e2" and the previous (past) note on the one hand and the next (future) note on the other hand has, in this case, a value of 5 semitones.

If the test 1318 is positive, the note pitch is placed in the table of note pitches at the position J.

During an operation 1320, and if the selection of the next position (J+1) is made from the family of passing notes (as is the case here), the central processing unit 1106 reselects (corrects) the note located at the next position (J+1 at "e3") but this time the selection is made from the notes of the base family in order to comply with the "base note/passing note" alternation imposed here.

Next, the test 1322 checks whether "J" is the last location "e2" to be treated. If this is not the case, the variable "J" corresponding to the position of the piece is incremented by 4 and the same operations 1312 to 1322 are carried out at the new position J.

If the test 1322 is negative (there is no note at the position "J"), and during an operation 1324, "J" is incremented by 4 (next position "e2") and the same operations 1312 to 1322 are carried out at the new position.

Figure 19:
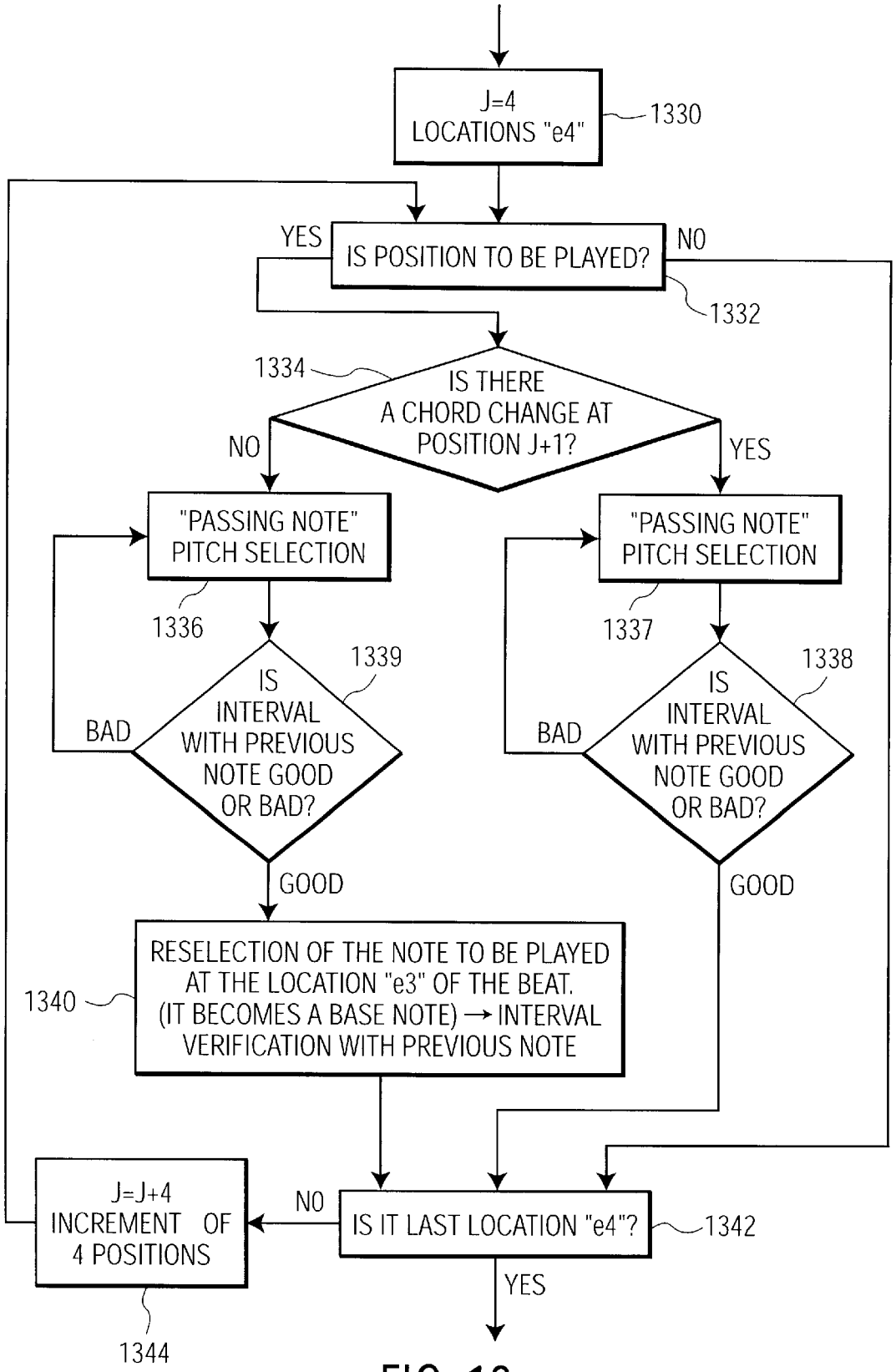

The operations and tests in FIG. 19 relate to the selection of notes to be played at the locations "e4". As previously, in the selection at the locations "e1", "e3" then "e2", the positions in question are treated in increments of 4 positions (position 2, then position 6, then position 10, etc.).

During an operation 1330, the "J" position indicator is initialized to the position "4" and then, during the test 1332, the central processing unit 1106 checks, in the table of rhythmic cadences for the melody, if the position "J" corresponds to a note to be played.

If the test 1332 is positive, the central processing unit 1106 during another rest 1334 checks whether the chord located at the next position J+1 is different from that of the current position J.

If the result of the test 1334 is negative, the central processing unit 1106 during an operation 1336 reads, from the table of chords at the position "J", the current chord and the scale of the base harmony (tonality). The central processing unit 1106 then randomly selects one of the note pitches from the family of passing notes.

The positions at the locations "e4" always receive notes of the passing family apart from in the following exceptional cases:

- the chord placed at the next position J+1 is different from that of the current position "J";
- the position to be treated is isolated, that is to say without a note immediately in front of it (past note) and without a note immediately after it (future note);
- the next position (future position at "e1") is a rest position.

In all these exceptional cases, the position at the location "e4" receives a base note.

The presence of a note to be played at "e4" implies correction of the previous and immediately adjacent note at "e3" (FIG. 25).

During a test 1339, the central processing unit 1106 looks for the previous position to be played ("e1", "e2" or "e3") and then the note pitch at this position.

The interval separating the previous note from the note currently selected is calculated. If this interval is too large, the test 1339 is negative. The central processing unit 1106 then makes, during an operation 1336, a new selection at the same position J.

The maximum allowed magnitude of the interval between the notes of the locations "e4" and the previous (past note) on the one hand and the next (future note) on the other hand has, here, a value of 5 semitones.

If the test 1339 is positive, the note pitch is placed in the table of note pitches at the position J.

During an operation 1340, and if the selection of the previous position (J−1) is made from the family of passing notes, the central processing unit 1106 reselects (corrects) the note located at the previous position (J−1, and therefore at "e3"), but this time the selection is made from the notes of the base family in order to comply with the "base note/passing note" alternation imposed here.

Next, the test 1342 checks whether "J" is the last location ("e4") to be treated. If this is not so, the variable "J" corresponding to the position of the piece is incremented by 4 and the same operations 1332 to 1342 are carried out for the new position J.

If the test 1342 is negative (there is no note at the position "J"), and during an operation 1344, "J" is incremented by 4 (next position "e4")—thus the same operations 1332 to 1342 are carried out at the new position.

Figure 20:
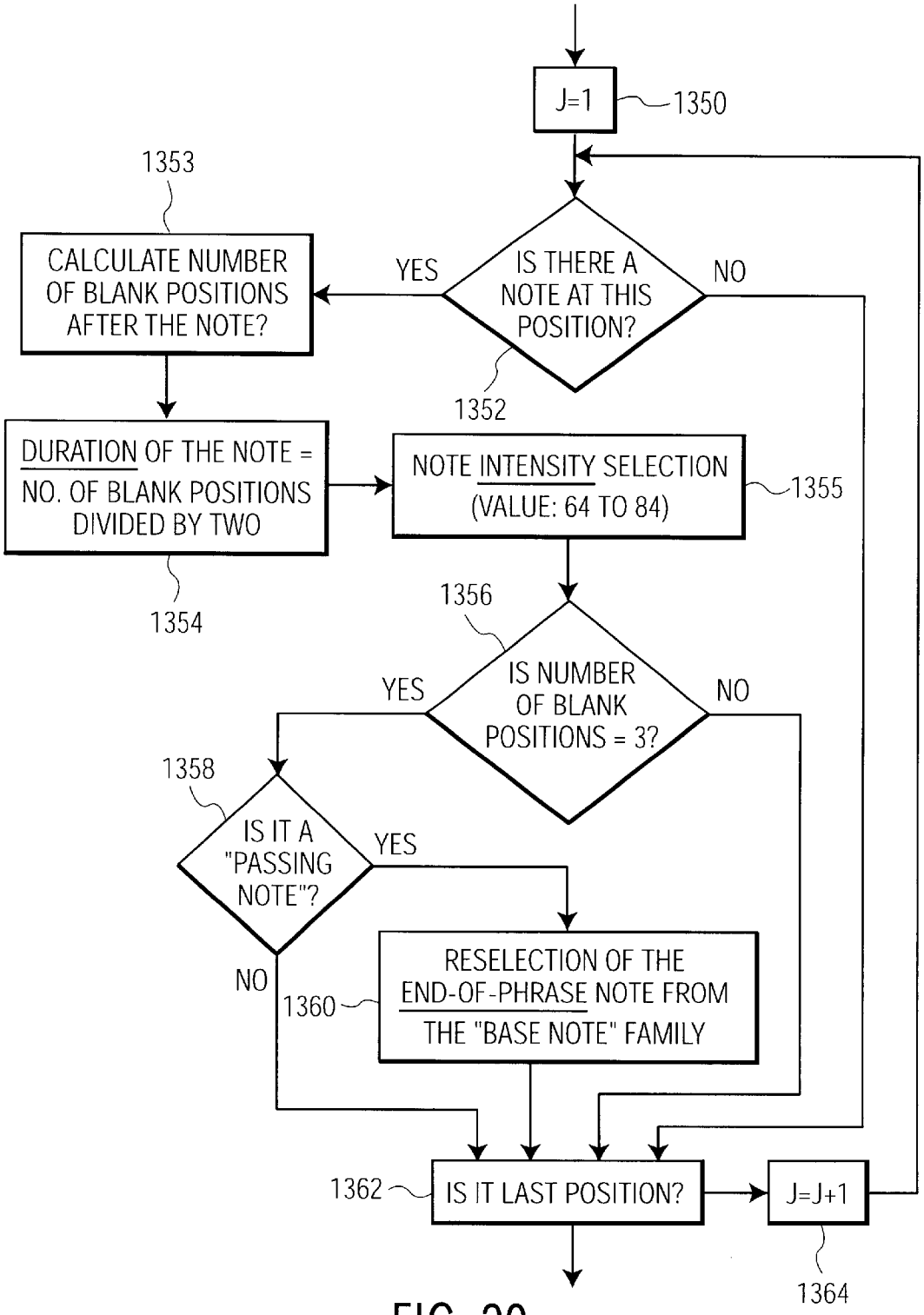

Next, FIG. 20 shows the operations (again relating to the notes of the melody):

- of calculating the note lengths (durations);
- of selecting the intensities (volume) of the notes;
- of looking for and correcting the notes located at the end of the various musical phrases generated previously.

These operations are performed chronologically from the "1" position to the "256" position.

During an operation 1350, the variable "J" is initialized to 1 (first position) and then, during a test 1352, the central processing unit 1106 reads, from the table of the rhythmic cadences for the melody, whether the position "J" has to be played.

If the test 1352 is positive (the current position "J" is a position to be played), the central processing unit 1106 counts the positions of rests located after the current "J" position (the future).

During an operation 1354, the central processing unit 1106 calculates the duration of the note placed at the position J: the number (an integer) corresponding to half the total of the positions of rests found.

A "1" value indicating a "note off" is placed in a subtable of note durations, which also has 256 positions, at the position corresponding to the end of the last position of the duration. This instruction will be read, during the playing phase, and will allow the note to be "cut off" at this precise moment.

The "note off" determines the end of the length of the previous note, the shortest length here being a semiquaver (a single position of the piece).

Example: 4 blank positions have been found after a note placed at the "1" position (J=1). The duration of the note is then 2 positions (4/2 . . . it is recalled here that these are positions on a timescale) to which is added the duration of the initial position "J" of the note itself, i.e. a total duration of 3 positions corresponding here to 3 semiquaver rests, i.e. a dotted quaver rest.

Here the quavers which follow one another are linked together (only a single blank position between them).

Other systems for calculating the note durations may be produced for other methods of implementation or other music styles:

- quantization of the rest: a duration corresponding to a multiple of the time unit, here a semiquaver, i.e. in rest value a semiquaver rest);
- maximum extension of the duration for songs referred to as "broad-sweeping";
- splitting the initial duration into two for notes played staccato;
- durations chosen by random selection, these being limited by the number of rest positions available (between 1 and 7, for example).

During an operation 1355, the central processing unit 1106 reads the various intensity values from the read-only memory 1105 and assigns them to the melody note intensity table according to:

- the location ("e1" to "e4") of the notes within the beat; and
- their position in the piece.

Intensities of the notes to be played as a function of their location within the beat of the bar:

| Location | Intensity (MIDI code: 0 to 127) |
|---|---|
| "e1" | 65 |
| "e2" | 75 |
| "e3" | 60 |
| "e4" | 58 |

The intensity of the notes, with respect to the locations, contributes to giving the music generated a character or style.

Here, the intensity of the notes at the end of a phase is equal to 60 (low intensity) unless the note to be treated is isolated by more than 3 positions of rests in front of it (in the past) and after it (in the future), where in this case the intensity of the note is equal to 80 (moderately high intensity).

Next, during a test 1356, the central processing unit 1106 checks whether the number of rests lying after the note and calculated during operation 1353 is equal to or greater than 3.

If the test 1356 is positive and the note to be played at the position "J" is from the family of passing notes, the note at the current position (J) is regarded as a "note at the end of a musical phrase" and must absolutely be taken from the family of base notes during operation 1360.

Next, a test 1362 checks whether the position J is equal to 256 (end of the tables). If the test 1362 is negative, "J" takes the value J+1 and the operations and tests 1352 to 1362 are carried out again at the new position.

If the test 1362 is positive, a binary selection operation is carried out in order to decide the method of generating the rhythmic cadence of the arpeggios.

When the result of the selection is positive, the value 1 is assigned to the variable J during an operation 1372.

Next, during an operation 1374 a binary random selection is made.

When the result of the selection in operation 1374 is positive, a value "1" is written into the arpeggio rhythmic cadence table.

Next, the test 1376 checks if J=16.

It should be mentioned here that two different cadences of a bar (16 positions) are selected randomly and repeated, one over the entire 8 bars of the couplet and the other over the entire 8 bars of the refrain.

Figure 21:
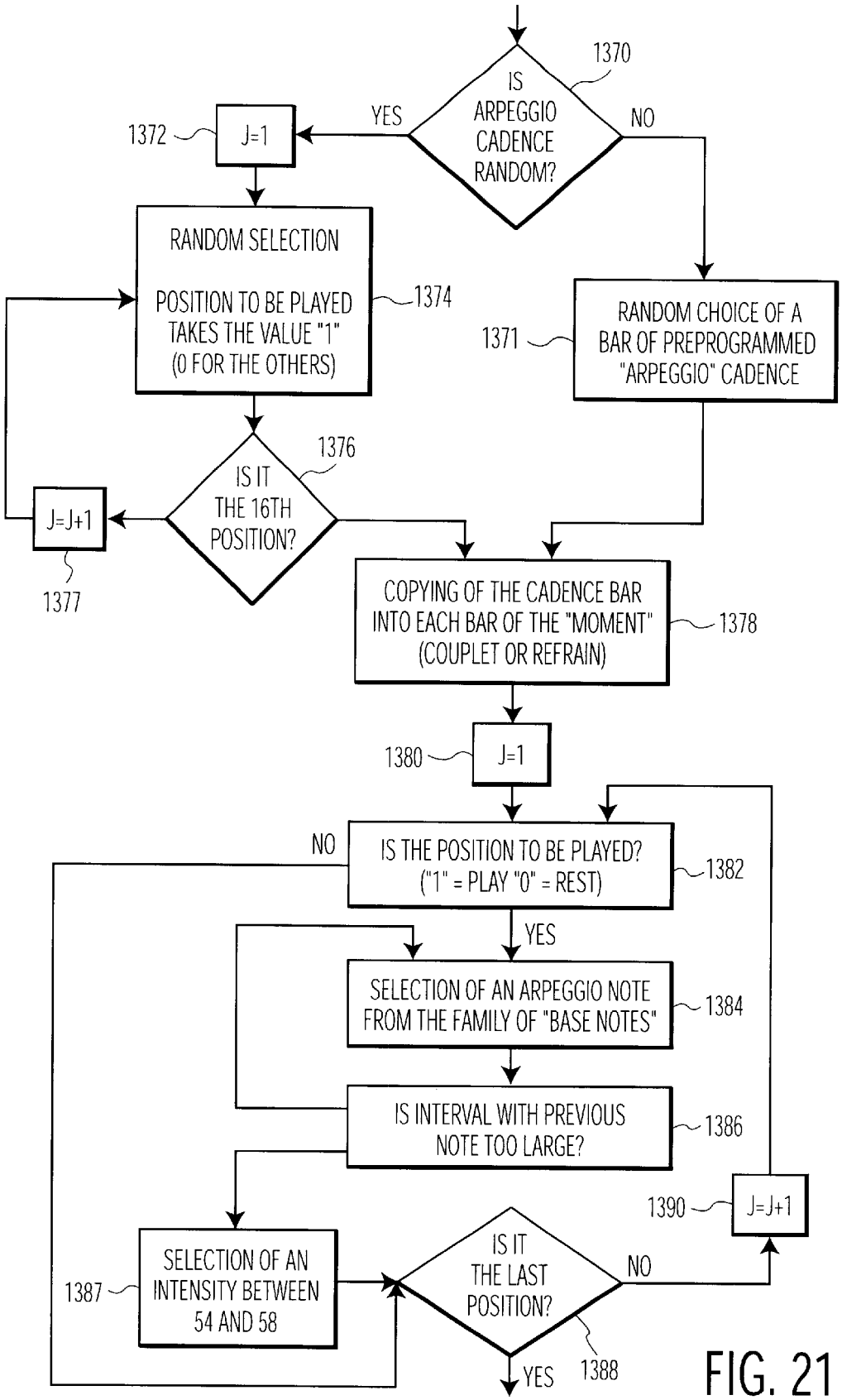
Figure 22:
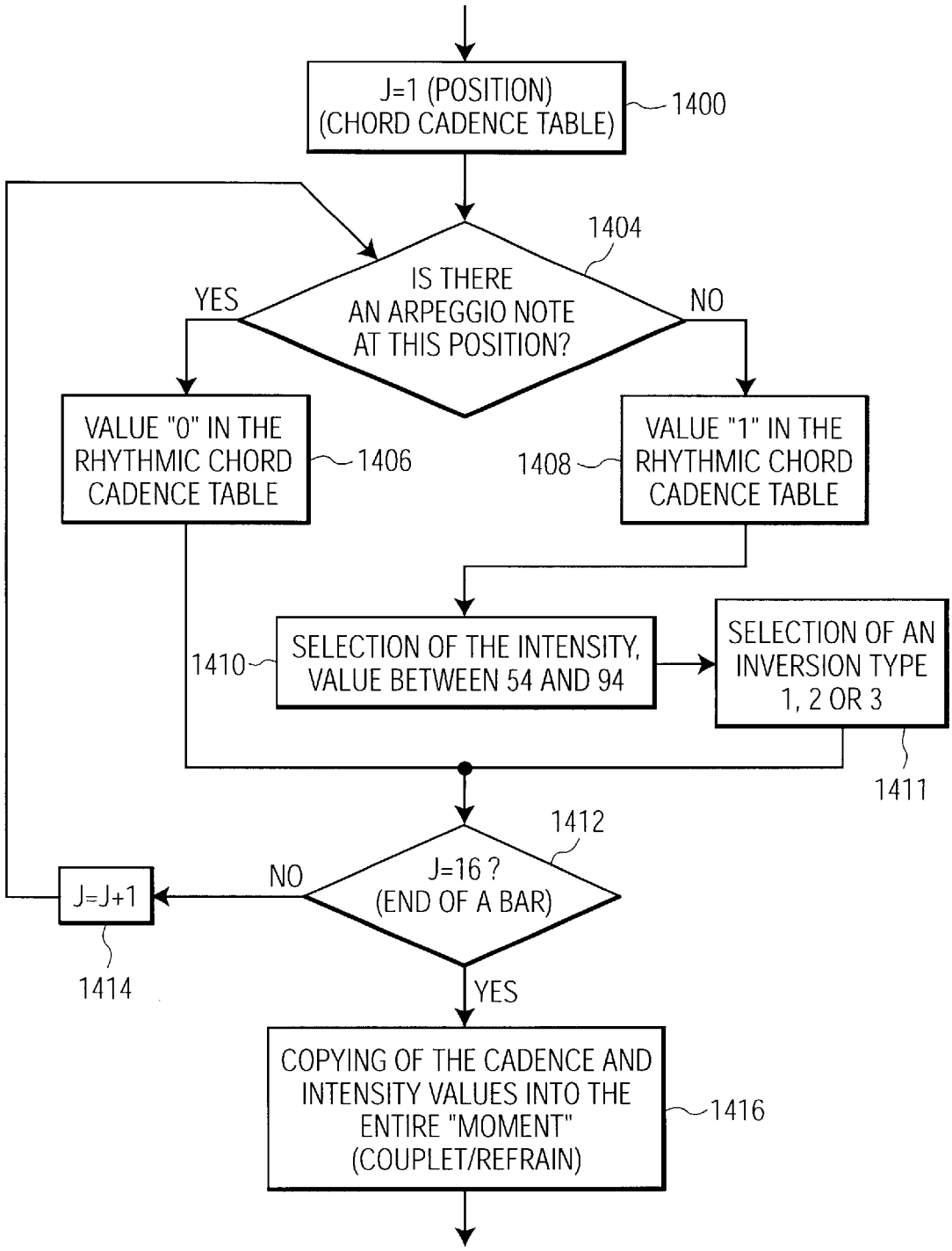
Figure 23:
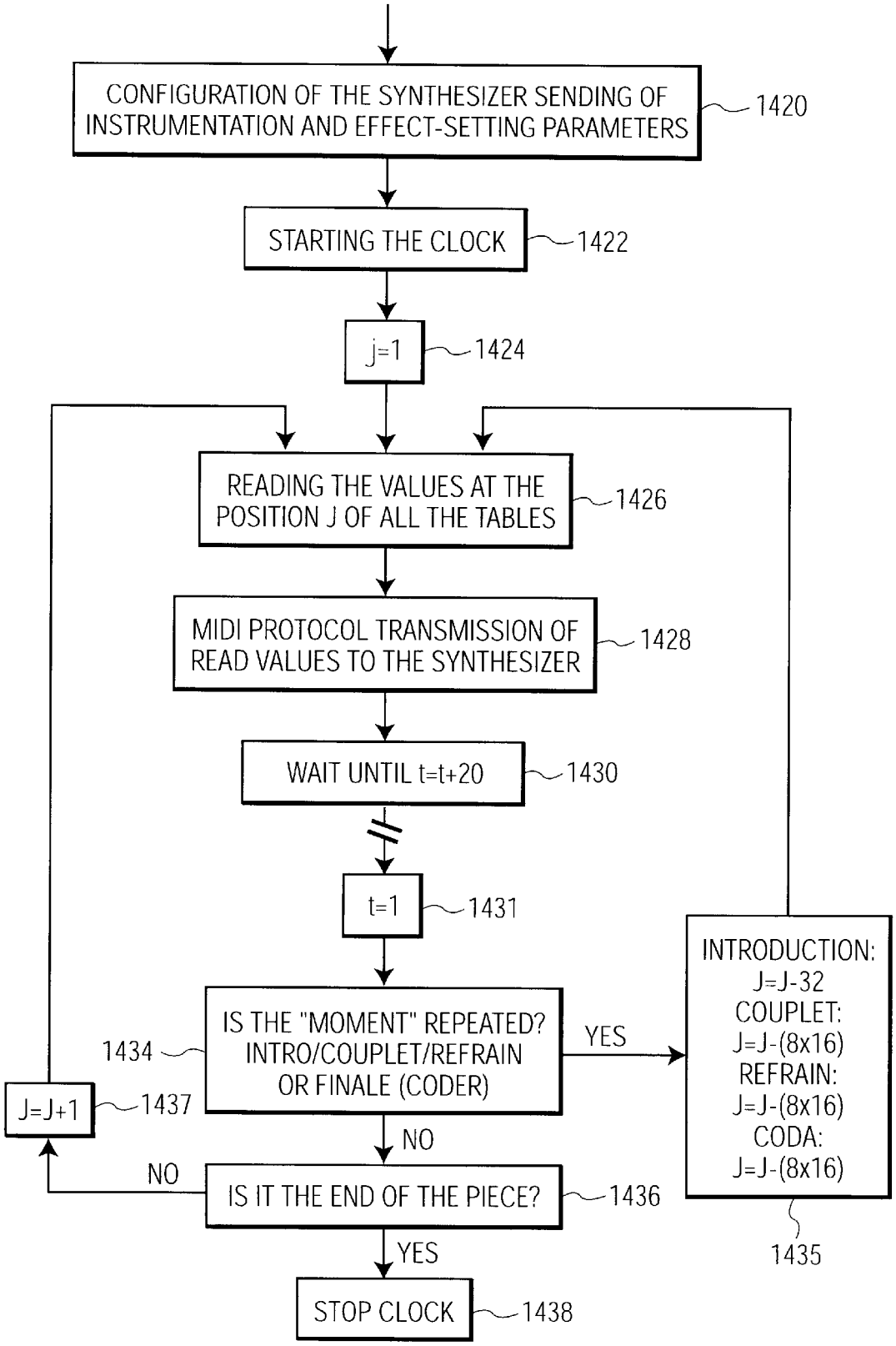

The operations relating to a single cadence are represented here in FIG. 21, those relating to the second cadence being identical.

If the test 1376 is negative, J is incremented by "1" during an operation 1377 and the operations 1374 to 1376 are carried out again.

If the test 1376 is positive, the central processing unit 1106 during an operation 1378 puts an identical copy of this cadence bar into all the bars of the moment in question (couplet or refrain).

If the test 1370 is negative, the central processing unit 1106, during an operation 1371, randomly selects one of the bars (16 positions) of rhythmic cadences preprogrammed in the read-only memory 1105.

Then, during an operation 1380, J is reinitialized, taking the value "1".

Next, during a test 1382, the central processing unit 1106 checks in the melody rhythmic cadence table whether this position "J" is a position for a note to be played.

If the result of the test 1382 is positive, the central processing unit, during an operation 1384, reads the current chord and then randomly selects a note of the base family.

Next, during an operation 1386, the central processing unit makes a comparison of the interval of the note selected and the previous note.

If the interval exceeds the maximum allowed interval (in this case 5 semitones), operation 1384 is repeated.

If the interval does not exceed the maximum allowed interval, the central processing unit then randomly selects, during an operation 1387, the intensity of the arpeggio note from the numbers read from the read-only memory (e.g. 68, 54, 76, 66, etc.) and writes it into the table of the intensities of the arpeggio notes at the position J.

During the test 1388, the central processing unit checks if J=256.

If the test 1388 is negative, the value J is incremented by 1 and operations 1382 to 1388 are repeated at the new position.

If the test 1388 is positive, during operation 1400 the value J is initialized to the value "1".

During a test 1404, the central processing unit reads from the arpeggio table whether an arpeggio note to be played at the location J exists.

If the result of the test 1404 is positive, the position J of the chord rhythmic cadence table keeps a value "0" during operation 1406.

Then, during a test 1412, the central processing unit checks whether J=256.

If the result of the test 1412 is negative, the variable J is incremented by "1" and operation 1404 is then repeated.

If the result of the test 1404 is negative, during operation 1408 the position J in the chord rhythmic cadence table takes the value "1" (chord to be played when there is no arpeggio note to be played).

Next, during operation 1410, the central processing unit 1106 makes a selection from two values (in this case 54 and 74) of rhythmic chord intensities stored in the read-only memory 1105 and writes it into the table corresponding to the position J.

Next, during operation 1411, the central processing unit 1106 selects one of the two values (1, 2 or 3) of rhythmic chord inversion stored in the read-only memory 1105 and writes it into the table of chord inversions at the position J.

Each of these values defines the place of the notes to be played in the chord. Example of inversions of a chord of C major:

inversion 1=C3, E3, G3 (tonic, third, fifth);

inversion 2=G3, C3, E3 (fifth, tonic, third);

inversion 3=E3, G3, C3 (third, fifth, tonic);

the numbers "2", "3" and "4", placed after the note, indicating the octave pitch.

Next, during a test 1412, the central processing unit 1106 checks whether J is equal to 16 (end of the cadence bar).

If the test 1412 is negative, during an operation 1414 J is incremented by "1" and operation 1404 is repeated for the new position J.

If the test 1412 is positive, during an operation 1416:

the cadence value is copied into the entire couplet (positions 1 to 128) in the "chord rhythmic cadence" subtable;

the intensity value is copied into the entire couplet (positions 1 to 128) in the "rhythmic chord intensity" subtable;

the inversion value is copied into the entire couplet (positions 1 to 128) in the "rhythmic chord inversion" subtable.

It should be pointed out that operations 1400 to 1416 above relating to the couplet are the same for the refrain (positions 129 to 256).

Next, during an operation 1420, the central processing unit sends the various General MIDI configuration, instrumentation and sound-setting parameters to the synthesizer 1109 via the MIDI interface 113. It will be recalled that the synthesizer was initialized during operation 1200.

Next, during operation 1422, the central processing unit initializes the clock to t=0.

Next, if the value of "t" is 20, all of the results of the operations at position "J" described below (and shown in FIG. 23) will be sent to the synthesizer.

These signals are sent every $^{20}/_{200}{}^{th}$ of a second, and for each position (1 to 256), respecting the repeats of the various "moments".

Next, during an operation 1424, the position "J" is initialized and receives the value. "1".

During an operation 1426, the central processing unit 1106 reads the values of each table and sends them to the synthesizer 1428 in a MIDI protocol form.

After all the playing parameters have been sent, the central processing unit 1106 waits for the $^{20}/_{200}{}^{th}$ of a second have elapsed (t=t+20 in the example chosen).

During operation 1431, the central processing unit reinitializes "t" ("t"=0).

Next, during a test 1434, the central processing unit 1106 checks whether the position J is the end of the current "moment" (end of the introduction, of the couplet, etc.).

If the test 1434 is negative, the central processing unit 1106 then checks, during a test 1436, whether the position J (depending on the values of repeats) is not that corresponding to the end of the piece.

If the test 1436 is negative, J is incremented by 1 during operation 1437 and then operation 1426 is repeated.

If the test 1434 is positive, the situation corresponds to the start of a "moment" (e.g. the start of a couplet).

It will be recalled that the introduction has a length of 2 bars (these are the first two bars of the couplet), the couplet has a length of 8 bars and the refrain a length of 8 bars.

Each moment is played successively two times and the finale (coda) is the repetition of the refrain (three times with fade out).

In addition, during operation 1435, the variable J takes the following values in succession:

end of the introduction: J=J−32 end of the couplet: J=J−(8×16)

end of the refrain: J=J−(8×16)

repetition of the refrain (coda) J=J−(8×16)

Next, operation 1426 is repeated at the new position J.

If the test 1436 is positive, the set of operations is completed, unless the entire music generation process described above is put into a loop. In this case, continuous music is heard.

Then, depending on the computation speed of the microprocessor used, the various pieces form a sequence after a silence of a few tenths of a second, during which the "partition" of a new piece is generated.

What is claimed is:

1. An automatic music generation procedure, wherein it comprises:

an operation of defining musical moments during which at least four notes are capable of being played;

an operation of defining two families of note pitches, for each musical moment, the second family of note pitches having at least one note pitch which is not in the first family;

an operation of forming at least one succession of notes having at least two notes, each succession of notes being called a musical phrase, in which succession, for each moment, each note whose pitch belongs exclusively to the second family is surrounded exclusively by notes of the first family; and an operation of outputting a signal representative of each note pitch of each said succession.

2. The music generation procedure as claimed in claim 1, wherein, during the operation of defining two families of note pitches, for each musical moment, the first family is defined as a set of note pitches belonging to a chord duplicated from octave to octave.

3. The music generation procedure as claimed in claim 2, wherein, during the operation of defining two families of note pitches, the second family of note pitches includes at least the note pitches of a range which are not in the first family of note pitches.

4. The music generation procedure as claimed in claim 1, wherein, during the operation of forming at least one succession of notes having at least two notes, each musical phrase is defined as a set of notes the starting times of which are not mutually separated, in pairs, by more than a predetermined duration.

5. The music generation procedure as claimed in claim 1, wherein it furthermore includes an operation of inputting values representative of physical quantities and in that at least one of the operations of defining musical moments, of defining two families of note pitches, of forming at least one succession of notes, is based on at least one value of a physical quantity.

6. The music generation procedure as claimed in claim 5, wherein said physical quantity is representative of a movement.

7. The music generation procedure as claimed in claim 5, wherein said physical quantity is representative of an input on keys.

8. The music generation procedure as claimed in claim 5, wherein said physical quantity is representative of an image.

9. The music generation procedure as claimed in claim 5, wherein said physical quantity is representative of a physiological quantity of the user's body, preferably obtained by means of at least one of the following sensors:

an actimeter;

a tensiometer;

a pulse sensor;

a friction sensor;

a sensor for detecting the pressure at various points on gloves and/or shoes; and a sensor for detecting pressure on arm and/or leg muscles.

10. The music generation procedure as claimed in claim 1, wherein it comprises:

an operation of processing information representative of a physical quantity during which at least one value of a parameter called a "control parameter" is generated;

an operation of associating each control parameter with at least one parameter called a "music generation parameter" corresponding to at least two notes to be played during a musical fragment; and a music generation operation using each music generation parameter to generate a musical fragment.

11. The music generation procedure as claimed in claim 10, wherein the music generation operation comprises, successively:

an operation of automatically determining a musical structure composed of moments comprising bars, each bar having times and each time having note start locations;

an operation of automatically determining densities, probabilities of the start of a note to be played, these being associated with each location; and an operation of automatically determining rhythmic cadences according to densities.

12. The music generation procedure as claimed in claim 10, wherein the music generation operation comprises:

an operation of automatically determining harmonic chords which are associated with each location;

an operation of automatically determining families of note pitches according to the rhythmic chord which is associated with a position; and an operation of automatically selecting a note pitch associated with each location corresponding to the start of a note to be played, according to said families and to predetermined composition rules.

13. The music generation procedure as claimed in claim 10, wherein the music generation operation comprises:

an operation of automatically selecting orchestral instruments;

an operation of automatically determining a tempo;

an operation of automatically determining the overall tonality of the fragment;

an operation of automatically determining a velocity for each location corresponding to the start of a note to be played;

an operation of automatically determining the duration of the note to be played;

an operation of automatically determining rhythmic cadences of arpeggios; and/or an operation of automatically determining rhythmic cadences of accompaniment chords.

14. The music generation procedure as claimed in claim 13, wherein, during the music generation operation, each density depends on said tempo.

15. The music generation procedure as claimed in claim 10, wherein said procedure comprises a music generation initiation operation comprising an operation of connection to a network, for example the Internet network.

16. The music generation procedure as claimed in claim 10, wherein said procedure comprises a music generation initiation operation comprising an operation of transmitting a predetermined play order via a network server to a tool capable of carrying out the music generation operation.

17. The music generation procedure as claimed in claim 15, wherein it comprises an operation of downloading, into the computer of a user, a software package allowing the music generation operation to be carried out.

18. The music generation procedure as claimed in claim 10, wherein said procedure comprises a music generation initiation operation comprising an operation of reading a sensor.

19. The music generation procedure as claimed in claim 1, wherein at least one of the notes has a pitch which depends on the pitch of the notes which surround it.

20. The music generation procedure as claimed in claim 1, wherein it includes a first operation of determining the pitch of notes which are positioned at predetermined locations and a second operation of determining the pitch of other notes during which the pitch of a note depends on the note pitches of the notes which surround said note and which are at said predetermined locations.

21. The music generation procedure as claimed in claim 1, wherein the note pitches are determined in an achronic order.

22. An automatic music generation system, wherein it comprises:

a means of defining musical moments during which at least four notes are capable of being played;

a means of defining two families of note pitches, for each musical moment, the second family of note pitches having at least one note pitch which is not in the first family of note pitches;

a means of forming at least one succession of notes having at least two notes, each succession of notes being called a musical phrase, in which succession, for each moment, each note whose pitch belongs exclusively to the second family is surrounded exclusively by notes of the first family; and a means of outputting a signal representative of each note pitch of each said succession.

23. The music generation system as claimed in claim 22, wherein the means of defining two families of note pitches is designed to define, for each musical moment, the first family as a set of note pitches belonging to a chord duplicated from octave to octave.

24. The music generation system as claimed in claim 23, wherein the means of defining two families of note pitches is designed to define the second family of note pitches so that it includes at least the note pitches of a range which are not in the first family of note pitches.

25. The music generation system as claimed in claim 22, wherein the means of forming at least one succession of notes having at least two notes is designed so that each musical phrase is defined as a set of notes the starting times of which are not mutually separated, in pairs, by more than a predetermined duration.

26. The music generation system as claimed in claim 22, wherein it furthermore includes a means of inputting values representative of physical quantities and in that at least one of the means of defining musical moments, of defining two families of note pitches, of forming at least one succession of notes, is designed to take into account said value of at least one value of a physical quantity.

27. The music generation system as claimed in claim 22, wherein it comprises:

a means of processing information representative of a physical quantity designed to generate at least one value of a parameter called a "control parameter";

a means of associating each control parameter with at least one parameter called a "music generation parameter" each corresponding to at least two notes to be played during a musical fragment;

a music generation means using each music generation parameter to generate a musical fragment.

28. The music generation system as claimed in claim 22, wherein the means of forming a succession is designed so that at least one of the notes has a pitch which depends on the pitch of the notes which surround it.

29. The music generation system as claimed in claim 22, wherein the means of forming a succession is designed to determine pitches of notes positioned at predetermined locations and to determine pitches of other notes during which the pitch of a note depends on the note pitches of the notes which surround said note and which are at said predetermined locations.

30. The music generation system as claimed in claim 22, wherein the means of forming a succession is designed to determine the note pitches in an achronic order.

31. An electronic and/or video game comprising a music generation system as claimed in claim 22.

32. The game as claimed in claim 31, wherein at least one parameter of musical fragments played by means of the music generation system depends on a phase of the game and/or on the results of a player.

33. A computer comprising a music generation system as claimed in claim 22.

34. A television transmitter comprising a music generation system as claimed in claim 22.

35. A television receiver comprising a music generation system as claimed in claim 22.

36. A telephone receiver comprising a music generation system as claimed in claim 22.

37. The telephone receiver as claimed in claim 36, wherein the music generation system is designed to control a musical ringing tone and in that said telephone receiver comprises means for customizing said ringing tone by the subscriber.

38. The telephone receiver as claimed in claim 36, wherein said telephone receiver comprises means for automatically associating a telephone ringing tone with the telephone number of the caller.

39. A datacom server intended to be connected to a telephone network, comprising a music generation system as claimed in claim 22.

40. A music broadcaster, preferably consisting of a synthesizer, comprising a music generation system as claimed in claim 22.

41. An electronic chip comprising a music generation system as claimed in claim 22.

* * * * *